US006310637B1

(12) United States Patent
Shimada et al.

(10) Patent No.: US 6,310,637 B1
(45) Date of Patent: Oct. 30, 2001

(54) METHOD OF PRINTING TEST PATTERN AND PRINTING APPARATUS FOR THE SAME

(75) Inventors: Kazumichi Shimada; Sa Liu, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/120,340

(22) Filed: Jul. 22, 1998

(30) Foreign Application Priority Data

Jul. 31, 1997 (JP) ..... 9-220782
Aug. 29, 1997 (JP) ..... 9-234705

(51) Int. Cl.[7] ..... B41J 29/393; B41J 2/205; B41J 23/00; B41J 2/145

(52) U.S. Cl. ..... 347/19; 15/37; 15/40

(58) Field of Search ..... 347/19, 37, 116, 347/133, 41, 40, 15; 400/120.02, 70, 61, 120, 76, 119

(56) References Cited

U.S. PATENT DOCUMENTS

| | | | | |
|---|---|---|---|---|
| 4,365,873 | * | 12/1982 | Ginsburg | 351/239 |
| 4,920,355 | * | 4/1990 | Katerberg | 347/41 |
| 5,084,758 | * | 1/1992 | Danzuka et al. | 358/296 |
| 5,530,460 | | 6/1996 | Wehl | 347/19 |
| 5,648,801 | * | 7/1997 | Beardsley et al. | 347/15 |
| 5,757,400 | * | 5/1998 | Hoisington | 347/40 |

FOREIGN PATENT DOCUMENTS

| | | |
|---|---|---|
| 0 589 718 | 3/1994 | (EP) . |
| 0 622 220 | 11/1994 | (EP) . |
| 0 631 257 | 12/1994 | (EP) . |
| 7-81190 | 3/1995 | (JP) . |

* cited by examiner

*Primary Examiner*—John Barlow
*Assistant Examiner*—Charles W. Stewart, Jr.

(57) ABSTRACT

In a printer that allows dual-way printing, a test pattern is formed to adjust the print timing with a high accuracy, or more concretely to eliminate a deviation of dots created in the course of a main scan in a backward direction from dots created in the course of the main scan in a forward direction. The test pattern is based on a normal dither matrix. The test pattern includes a plurality of dots that are regularly arranged both in a main scanning direction and in a sub-scanning direction. When the test pattern is printed at an appropriate timing, it is observed as a substantially homogeneous state without unevenness of the density. In case that the dot print timing is deviated, on the other hand, a deviation in dot interval causes unevenness of the density. The deviation of the dot print timing is accurately detected, based on the presence or the non-presence of such unevenness of the density. When the interval of the dots is set equal to the interval that realizes a spatial frequency giving a high visual sensitivity, unevenness of the density is observable more prominently. The deviation of the dot print timing may alternatively be detected by taking advantage of a moire pattern, which is caused by an overlap of an inspection pattern with oblique reference lines.

19 Claims, 23 Drawing Sheets

METHOD OF PRINTING TEST PATTERN AND PRINTING APPARATUS FOR THE SAME

BACKGROUND OF THE INVENTION

1. Field of the Invention

The present invention relates to a printer that allows dual-way printing and forms dots on a printing medium by main scans in both a forward direction and a backward direction, thereby printing an image. More specifically the present invention pertains to a technique that prints a test pattern in such a printer.

2. Description of the Prior Art

An ink jet printer is one typical example of printing apparatuses, in which a print head reciprocates in a main scanning direction to scan a printing medium in a sub-scanning direction and print an image. In these printers, the print head generally has a plurality of nozzles (hereinafter referred to as the multi-head), in order to improve the printing speed. In printers that allow color printing, the multi-head is generally provided for each color ink.

Some of these printers create dots not only in the course of the forward motion of the main scan but in the course of the backward motion of the main scan, in order to further improve the printing speed. In this printer, deviation of the dots created in the course of the backward motion of the main scan from the planned positions corresponding to the dots created in the course of the forward motion of the main scan results in unsuccessful printing of an image. This phenomenon is caused by a variety of factors, for example, the backlash or the play required for the driving mechanism of the printer and the difference in thickness of the sheet used as the printing medium.

FIGS. 42 and 43 show a deviation of dots due to the thickness of the sheet. In the example shown in FIG. 44, a dot dt11 is formed on a sheet of paper PA1 in the course of the forward motion of the main scan, and a dot dt12 is formed in the course of the backward motion of the main scan to be adjacent to the dot dt11. Nozzles Nz spray droplets of ink Ik11 and Ik12 at positions shown in FIG. 44 by taking into account the speeds of the main scan in the forward direction and in the backward direction. The ink droplets Ik11 and Ik12 draw the loci shown in FIG. 44 and reach the target positions to form the dots dt11 and dt12.

FIG. 45 shows formation of the dots when a sheet of paper PA2 has a greater thickness. In this case, the distance between the nozzle Nz and the sheet of paper PA2 is smaller than the distance between the nozzle Nz and the sheet of paper PA1 shown in FIG. 44. When ink is sprayed at the same timings as those in FIG. 44 in the forward course and the backward course of the main scan, droplets of ink Ik21 and Ik22 draw the loci shown in FIG. 45 and reach the illustrated positions to form dots dt21 and dt22. The resulting dots dt21 and dt22 do not adjoin to each other, so that the resulting image is different from the image to be printed originally. In order to obtain the image to be printed originally, the timing of spraying the ink in the backward course of the main scan should be delayed from the timing shown in FIG. 45.

The technique of adjusting the print timing based on a test pattern is adopted to eliminate such a deviation. This technique prints a predetermined test pattern while varying the dot print timing in the forward course and the backward course of the main scan. The dot print timing is selected that gives the optimum printing result among the test patterns printed at various timings. As discussed above, the thickness of the sheet is one factor that causes the deviation of the print timing. The adjustment of the print timing should thus be carried out by the user of the printer, in addition to the time of the delivery of the printer.

A line pattern as shown in FIG. 46 is conventionally used as the test pattern. The upper half of each line shown in FIG. 46 is printed by the forward motion of the main scan, whereas the lower half is printed by the backward motion of the main scan. Varying the dot print timing causes a change of the positional relationship between the upper half and the lower half of each line as shown in (a) through (e). The line pattern of (c) is a favorable image in which there is no relative deviation of the lower half from the upper half. The timing corresponding to the line pattern of (c) should accordingly be selected as the dot print timing.

Another proposed technique (JAPANESE PATENT LAYING-OPEN GAZETTE No. 7-81190) fills a predetermined area with dots to form a solid test pattern when the dot print timing is appropriate. In case that the dot print timing is deviated from the appropriate timing, white streaks where no dots are formed appear in the area that is supposed to be solid. This technique selects the dot print timing that does not cause such white streaks as the appropriate dot print timing.

The print timing may, however, not be adjusted adequately with the line test pattern as shown in FIG. 46. FIG. 46 shows the enlarged test patterns for convenience of explanation. In the actual state, however, each line consists of one array of dots, so that it is difficult to distinguish the state of (b) or (d) from the ideal state of (c). The distinction is especially difficult for the unskilled user of the printer who is unfamiliar with the test patterns. In the recent advanced printers of the high resolution, unsuccessful adjustment of the print timing may result in unsuccessful printing of an image.

The print timing may also not be adjusted adequately with the solid test pattern where a predetermined area is filled with dots. The white streaks are extremely narrow, so that the ink blot on the paper makes it difficult to identify such white streaks.

SUMMARY OF THE INVENTION

The object of the present invention is thus to provide a technique that appropriately adjusts the print timings in a forward course and a backward course of a main scan.

At least part of the above and the other related objects is realized by a method of printing a test pattern on a printing medium by driving a print head to create dots while carrying out a main scan, which moves the print head forward and backward relative to the printing medium in a main scanning direction. The method includes the steps of:

(a) creating dots at a first timing that forms a first pattern in the course of the main scan in the forward direction, wherein the first pattern includes a dark portion having a certain area and a light portion having an area greater than the area of the dark portion that alternately appear at a first cycle in the main scanning direction in a predetermined first section of the printing medium; and (b) creating dots at a second timing that is supposed to form a second pattern in the course of the main scan in the backward direction, wherein the second pattern includes a dark portion having a certain area and a light portion having an area greater than the area of the dark portion that alternately appear at a second cycle in the main scanning direction in a predetermined second section of the printing medium, the predetermined second section at least partly overlapping the predetermined first section, and wherein the dark portion of the first pattern and the dark portion of the second pattern appear at a fixed interval in the main scanning direction in the overlapped area.

The present invention is also directed to a printing apparatus that drives a print head to create dots while carrying out a main scan, which moves the print head forward and backward relative to the printing medium in a main scanning direction, the printing apparatus carrying out a sub-scan that moves the printing medium relative to the print head in a sub-scanning direction, which is perpendicular to the main scanning direction, thereby printing an image on the printing medium. The printing apparatus includes: a forward-course pattern formation unit that drives the print head at a first timing that forms a first pattern in the course of the main scan in the forward direction, wherein the first pattern includes a dark portion having a certain area and a light portion having an area greater than the area of the dark portion that alternately appear at a first cycle in the main scanning direction in a predetermined first section of the printing medium; and a backward-course pattern formation unit that drives the print head at a second timing that is supposed to form a second pattern in the course of the main scan in the backward direction, wherein the second pattern includes a dark portion having a certain area and a light portion having an area greater than the area of the dark portion that alternately appear at a second cycle in the main scanning direction in a predetermined second section of the printing medium, the predetermined second section at least partly overlapping the predetermined first section, and wherein the dark portion of the first pattern and the dark portion of the second pattern appear at a fixed interval in the main scanning direction in the overlapped area.

In the printing apparatus and the method of printing a test pattern according to the present invention, one test pattern is printed by superposing the second pattern created in the course of the main scan in the backward direction upon the first pattern created in the course of the main scan in the forward direction. The light-dark contrast appears repeatedly in the main scanning direction in both the first pattern and the second pattern. The area of the light portion is greater than the area of the dark portion in both the first pattern and the second pattern. The light-dark contrast thus appears repeatedly in the main scanning direction in the test pattern obtained by superposing the second pattern upon the first pattern. When printing in the forward course of the main scan and printing in the backward course of the main scan are performed at the appropriate timings, the dark portions appear at fixed intervals in the main scanning direction in the resulting printed test pattern. When the interval is sufficiently small, the area where the test pattern is printed is visually observed as the area of the uniform density as a whole. When the print timings are inappropriate, on the contrary, the interval between the dark portions of the test pattern is varied. In this case, the area where the test pattern is printed is visually observed as the area of the uneven density as a whole.

In the printing apparatus and the method of the present invention, it is determined whether or not the print timing is appropriate, based on the evenness or the unevenness of the density in the whole area where the test pattern is printed. The visual sensitivity of the human being is relatively high with respect to the unevenness of the density in the whole area. The printing apparatus and the method of the present invention accordingly enable the print timings in the forward course and the backward course of the main scan to be adjusted appropriately.

In the specification hereof, the light portion includes the area that has a low density of dots as well as the area in which no dots are formed.

In accordance with one preferable application of the method, the step (a) creates a plurality of dots that are apart from each other by a predetermined first interval in the main scanning direction and apart from each other by a predetermined second interval in a sub-scanning direction. The step (b) creates a plurality of dots at positions that are to satisfy at least either one of a position that is apart from each of the plurality of dots created in the step (a) by approximately half the predetermined first interval in the main scanning direction and a position that is apart from each of the plurality of dots created in the step (a) by approximately half the predetermined second interval in the sub-scanning direction.

In accordance with one preferable application of the printing apparatus, the forward-course pattern formation unit drives the print head to create a plurality of dots that are apart from each other by a predetermined first interval in the main scanning direction and apart from each other by a predetermined second interval in a sub-scanning direction. The backward-course pattern formation unit drives the print head to create a plurality of dots at positions that are to satisfy at least either one of a position that is apart from each of the plurality of dots created by the forward-course pattern formation unit by approximately half the predetermined first interval in the main scanning direction and a position that is apart from each of the plurality of dots created by the forward-course pattern formation unit by approximately half the predetermined second interval in the sub-scanning direction.

When printing is carried out at the appropriate print timing, the test pattern obtained by superposing the second pattern created in the backward course of the main scan upon the first pattern created in the forward course of the main scan includes a plurality of dots that are arranged regularly at fixed intervals both in the main scanning direction and in the sub-scanning direction in a specific area. This test pattern is visually observed as the homogeneous pattern without any unevenness of the density.

When the print timing is deviated from the appropriate state, on the other hand, the plurality of dots formed by the forward motion and the backward motion of the main scan do not have uniformity. There are accordingly dense-dot portions and sparse-dot portions. The dense-sparse contrast is observed as the unevenness of the density in the area where the dots are created. The printing apparatus and the method of the above structure determine the existence or non-existence of unevenness of the density and thereby adjust the print timing appropriately.

In the printing apparatus for printing the test pattern, it is preferable that the print head has a plurality of nozzles that are disposed at a predetermined nozzle interval, which is greater than a printing pitch of dots in the sub-scanning direction and that one of the predetermined second interval and the predetermined nozzle interval is an integral multiple of the other.

As described in the prior art, in the printing apparatuses that create dots to print an image, a plurality of nozzles are formed on the print head. In some of these printers, the nozzle interval in the sub-scanning direction is greater than the printing pitch in the sub-scanning direction. In these printers, the predetermined second interval, that is, the interval between the dots in the sub-scanning direction of the test pattern, is made coincident with an integral multiple of the nozzle interval or the reciprocal of the integral multiple. This enables the test pattern to be created efficiently.

The predetermined second interval includes the printing pitch in the sub-scanning direction. In this case, each of the first pattern and the second pattern includes a plurality of parallel lines arranged at an equal interval in the main scanning direction.

In the printing apparatus of the present invention, it is preferable that the dark portion of the first pattern and the dark portion of the second pattern alternately appear in the main scanning direction at a spatial frequency of 0.4 to 2.0 cycles/mm in the overlapped area.

As described above, the printing apparatus of the present invention determines the existence or non-existence of the unevenness of the density appearing in the printed test pattern and thereby adjusts the dot printing timing. It is generally known that the visual sensitivity of the human being is varied with a variation in spatial frequency. The visual sensitivity is relatively high in the range of the spatial frequency of 0.4 to 2.0 cycles/mm. Setting the spatial frequency of the test pattern in the range of 0.4 to 2.0 cycles/mm accordingly enables the light-dark contrast due to the deviation of the dot print timing to be observed with a high sensitivity. From that point of view, it is not required to restrict the spatial frequency of the test pattern strictly to the range of 0.4 to 2.0 cycles/mm. The spatial frequency of the test pattern may be out of this range as long as the unevenness of the density due to the deviation of the dot formation timing is observable with a high sensitivity.

From that point of view, the test pattern may be designed by the following method which is different from the conventional technique. In a printer that creates dots while carrying out a main scan, which moves a print head forward and backward relative to a printing medium, the present invention is accordingly directed to a method of designing a test pattern formed by the main scan both in the forward direction and in the backward direction. The test pattern includes a plurality of dots created at a predetermined interval in a predetermined area. The method of designing a test pattern includes the steps of:

specifying a spatial frequency that gives a maximum visual sensitivity of a human's eye with respect to lightness; and determining the predetermined interval of the dots, in order to cause a spatial frequency of the test pattern to be substantially equal to the specified spatial frequency.

In the test pattern designed according to this method of the present invention, the unevenness of the density due to the deviation of the print timing is readily observable.

In accordance with one preferable application of the method of printing a test pattern according to the present invention, either one of the step (a) and the step (b) forms a third pattern superposed upon the first pattern and the second pattern, the third pattern enabling a relative deviation of a printing position of the second pattern from a printing position of the first pattern to be observed as appearance of light-dark stripes.

In accordance with one preferable application of the printing apparatus according to the present invention, wherein either one of the forward-course pattern formation unit and the backward-course pattern formation unit drives the print head to form a third pattern superposed upon the first pattern and the second pattern, the third pattern enabling a relative deviation of a printing position of the second pattern from a printing position of the first pattern to be observed as appearance of light-dark stripes.

The printing apparatus of this structure creates the third pattern superposed upon the first pattern and the second pattern. The third pattern is formed either one of the forward motion and the backward motion of the main scan and is thereby not affected by the deviation of the print timing. The third pattern makes the relative deviation of the second pattern from the first pattern prominently observable as the appearance of the light-dark stripes. In accordance with a concrete procedure, superposing the third pattern upon the first pattern and the second pattern causes interference of the three patterns and thereby creates light-dark stripes or a moire pattern. When the print timing of the backward motion of the main scan is deviated from the print timing of the forward motion of the main scan, the printed position of the second pattern is deviated relatively from the printed position of the first pattern. This results in a change of the moire pattern. In general, the deviation of the print timing causes the change of the moire pattern to prominently appear. Namely even a slight deviation of the print timing significantly changes the moire pattern. The printing apparatus and the method of this preferable arrangement accordingly enable the print timing to be readily adjusted at a high accuracy. In the specification hereof, the moire pattern denotes a variation in density caused by the interference of the three patterns, which includes the case where these three patterns do not intersect one another.

The third pattern that can cause a moire pattern, for example, includes a plurality of parallel lines arranged at a fixed interval. The interval between the parallel lines constituting the third pattern is not specifically restricted. It is, however, preferable to select the interval that ascertains a prominent moire pattern based on the relation to the first pattern and the second pattern.

A variety of patterns may be applicable for the first pattern and the second pattern in the printing apparatus that takes advantage of the moire of the test pattern. By way of example, both the first pattern and the second pattern include a plurality of dots that are arranged at predetermined intervals in the main scanning direction and in the subscanning direction. In another example, parallel lines in the subscanning direction may be formed by superposing the first pattern and the second pattern, which are printed at the appropriate timings, upon each other.

Among the variety of available patterns, it is preferable that the first pattern and the second pattern include a plurality of parallel lines arranged at a predetermined interval.

This arrangement gives the test pattern that causes a prominent moire pattern and is thereby suitable for the adjustment of the print timing.

The parallel lines created as the third pattern may have any direction and interval. For example, the parallel lines constituting the third pattern may be parallel to the subscanning direction. Among the patterns consisting of various parallel lines, it is preferable that the third pattern includes a plurality of parallel lines that obliquely intersect a plurality of parallel lines constituting the first pattern and the second pattern at a predetermined angle.

This arrangement gives the test pattern that causes a prominent moire pattern and is thereby suitable for the adjustment of the print timing.

In this structure, it is preferable that the predetermined angle is in a range of not less than 2 degrees and not greater than 10 degrees.

The width of the stripes in the moire pattern is changed with a variation in deviation of the print timing. The deviation of the print timing is given as the deviation of the interval in the main scanning direction between the dots created in the forward course of the main scan and the dots created in the backward course at the currently specified print timing from the interval between these dots created at the appropriate print timing. The change of the moire pattern depends upon the angle of intersection. When the angle of intersection is not greater than 10 degrees, the width of the stripes in the moire pattern is proportional to the deviation of the print timing. In the case of an extremely small angle of intersection, the width of the moire stripes increases, and it is required to expand the area where the test pattern is printed. Setting the angle of intersection to be not less than 2 degrees allows the area where the test pattern is printed to be within a practical range. Even when the angle of intersection is out of the range of not less than 2 degrees and not greater than 10 degrees, however, it is possible to determine the deviation of the print timing by taking advantage of the moire pattern.

The printing apparatus that takes advantage of the moire pattern may further includes a camera with which a pattern printed on the printing medium is shot; and a detection unit that detects the relative deviation of the printing position of the second pattern from the printing position of the first pattern based on light-dark stripes appearing in the pattern shot with the camera.

The printing apparatus of this arrangement shoots the pattern printed on the printing medium as image data with the camera and automatically detects the deviation of the print timing based on the light-dark stripes of the input image data. This arrangement enables the deviation of the print timing to be recognized objectively and thereby ascertains accurate adjustment of the print timing. One preferable structure selects the appropriate print timing and thereby automatically adjusts the print timing. A variety of techniques may be applied to detect the deviation of the print timing based on the light-dark stripes. One concrete procedure stores in advance the relationship between the deviation of the print timing and the variation in width of the moire stripes and determines the deviation of the print timing based on the relationship.

An inspection printing medium discussed below may be used instead of printing the third pattern as described above. The inspection printing medium has a third pattern that is printed in advance in a specified area of the inspection printing medium. The specified area at least partly overlaps the predetermined first section in which the first pattern is formed in the forward course of the main scan and the predetermined second section in which the second pattern is formed in the backward course of the main scan. The third pattern enables a relative deviation of a printing position of the second pattern from a printing position of the first pattern to be observed as appearance of light-dark stripes.

Using the inspection printing medium of this arrangement also enables the print timing to be adjusted readily by taking advantage of the moire pattern.

In accordance with another preferable application, the printing apparatus of the present invention further includes a single-way pattern formation unit that drives the print head during the main scan only either in the forward direction or in the backward direction to print a pattern that is to be formed by both the forward-course pattern formation unit and the backward-course pattern formation unit in a specific area on the printing medium, the specific area being different from the predetermined first section in which the first pattern is formed by the forward-course pattern formation unit and the predetermined second section in which the second pattern is formed by the backward-course pattern formation unit.

The printing apparatus of this arrangement prints the test pattern, which is to be formed by both the forward-course pattern formation unit and the backward-course pattern formation unit, only in either of the forward course and the backward course of the main scan (hereinafter referred to as the single-way test pattern). The single-way test pattern thus created is the ideal test pattern without any deviation of the dot formation timing. The printing apparatus separately prints the test pattern in both the forward course and the backward course of the main scan (hereinafter referred to as the dual-way test pattern). The single-way test pattern and the dual-way test pattern are formed in different areas to avoid the overlap. The printing apparatus of this structure compares the dual-way test pattern with the single-way test pattern and thereby readily adjusts the print timing.

These two test patterns may be printed in any different areas that allow the comparison between the dual-way test pattern and the single-way test pattern to be readily performed. For example, these test patterns may be printed in contact with each other or via a small gap. In case that a plurality of dual-way test patterns are printed at a variety of dot formation timings, the single-way test pattern may be located between the plurality of dual-way test patterns or printed at a predetermined position in the vicinity of the dual-way test patterns. The structure of printing the single-way test pattern is applicable to the printing apparatus that takes advantage of the moire pattern.

A printer that can not print the single-way test pattern exerts the similar effects to those described above by using a printing medium described below. The printing medium used in the method of printing a test pattern according to the present invention is characterized by that a test pattern to be formed by the main scan both in the forward direction and in the backward direction is printed in advance in a specified area at an optimum dot formation timing during the main scan in the backward direction, wherein the specified area at least partly does not overlap the predetermined first section in which the first pattern is formed by the main scan in the forward direction or the predetermined second section in which the second pattern is formed by the main scan in the backward direction.

The computer controls operation of the print head in order to realize the arrangement of the printing apparatus. The present invention is thus directed to a recording medium on which a program for driving a print head and forming a test pattern, which includes a plurality of dots, on a printing medium is stored in a computer readable manner. The program includes: a first program code unit that causes a computer to realize a function that drives the print head at a first timing that forms a first pattern in the course of a main scan in a forward direction, wherein the first pattern includes a dark portion having a certain area and a light portion having an area greater than the area of the dark portion that alternately appear at a first cycle in the main scanning direction in a predetermined first section of the printing medium; and a second program code unit that causes the computer to realize a function that drives the print head at a second timing that forms a second pattern in the course of the main scan in a backward direction wherein the second pattern includes a dark portion having a certain area and a light portion having an area greater than the area of the dark portion that alternately appear at a second cycle in the main scanning direction in a predetermined second section of the printing medium, the predetermined second section at least partly overlapping the predetermined first section, and wherein the dark portion of the first pattern and the dark portion of the second pattern appear at a fixed interval in the main scanning direction in the overlapped area.

The computer executes the program to form the predetermined test pattern and thereby adjust the dot print timing of the printer. Available examples of the recording medium include flexible disks, CD-ROMs, magneto-optic discs, IC cards, ROM cartridges, punched cards, prints with barcodes or other codes printed thereon, internal storage devices (memories, such as a RAM and a ROM) and external storage devices of the computer, and a variety of other computer readable media. Another application of the present invention is a program supply device that supplies a computer program, which causes the computer to realize the respective steps or the functions of the respective units of the present invention described above, to the computer via a communications path.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS (1) Structure of System

Figure 1:
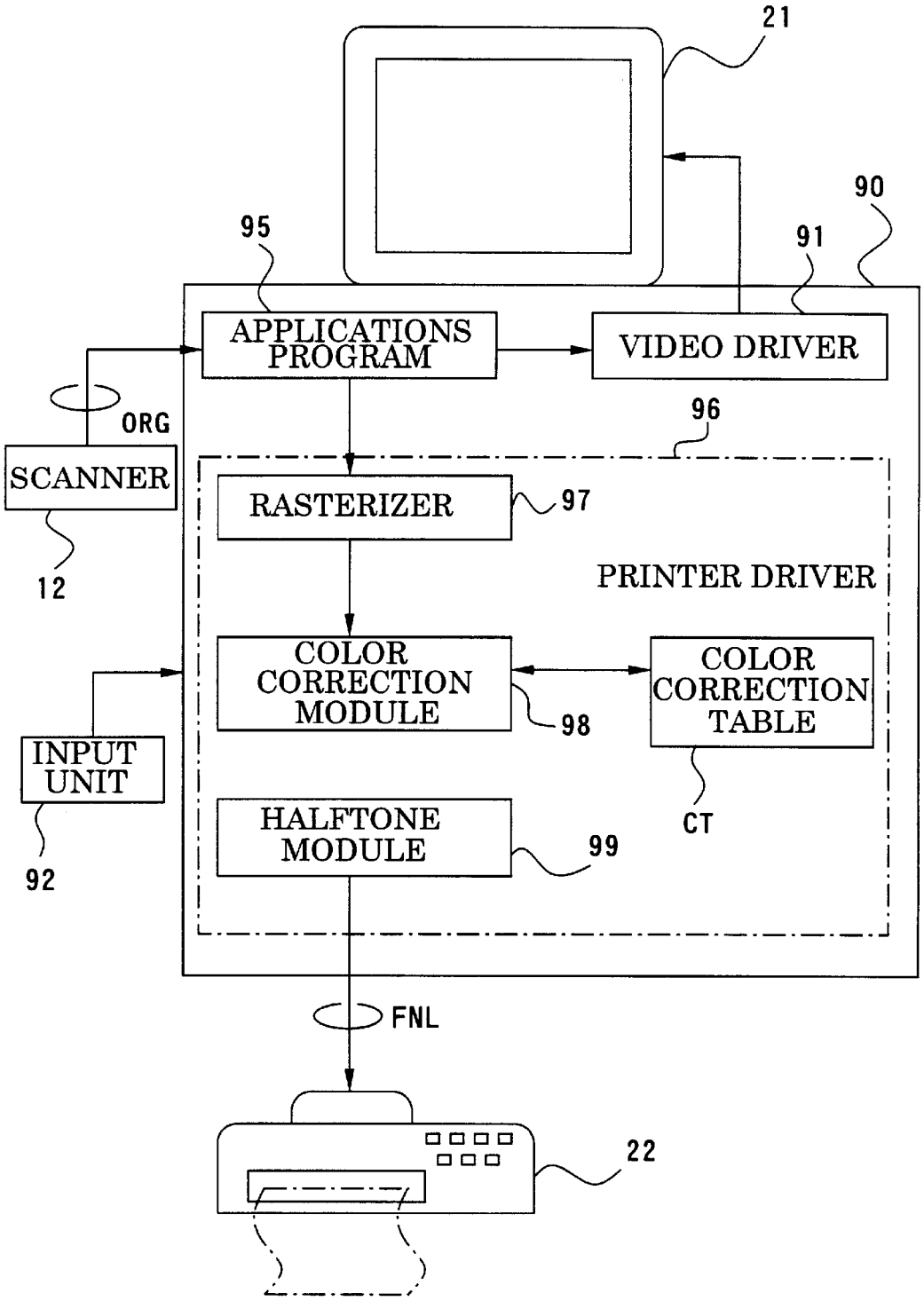
FIG. 1 is a block diagram schematically illustrating structure of an image processing system including a printer 22 embodying the present invention.

Outline of a color image processing system is described with the drawing of FIG. 1, in order to clarify the functions of a printer embodying the present invention. The color image processing system includes a scanner 12, a personal computer 90, and a color printer 22. The personal computer 90 has a color CRT display 21 and an input unit 92, which includes, for example, a keyboard and a mouse. The scanner 12 reads color image data from a color original and supplies original color image data ORG, which consist of data of three color components R, G, and B, to the computer 90.

The computer 90 includes a CPU, a RAM, and a ROM, which are not specifically illustrated herein. An applications program 95 runs under a predetermined operating system. A video driver 91 and a printer driver 96 are incorporated in the operating system, and final color image data FNL are output from the applications program 95 via these drivers 91 and 96. The applications program 95 reads an image with the scanner 12, causes the input image to be subjected to a predetermined processing operation, for example, retouch of the image, and displays a processed image on the CRT display 21 via the video driver 91. When the applications program 95 outputs a printing instruction, the printer driver 96 in the computer 90 receives image information from the applications program 95 and converts the input image information to signals printable by the printer 22 (binarized signals for the respective colors C, M, Y, and K). In the example of FIG. 1, the printer driver 96 includes a rasterizer 97 that converts the color image data processed by the applications program 95 into dot-based image data, a color correction module 98 that causes the dot-based image data to be subjected to color correction according to the ink colors C, M, and Y used by the printer 22 and the calorimetric characteristics of the printer 22, and a color correction table CT referred to by the color correction module 98. The printer driver 96 is further provided with a halftone module 99 that generates halftone image data, which express the density in a specific area by the existence or non-existence of ink in each dot unit, from the color-corrected image data. The printer 22 receives the printable signals and prints image information on a printing sheet.

Figure 2:
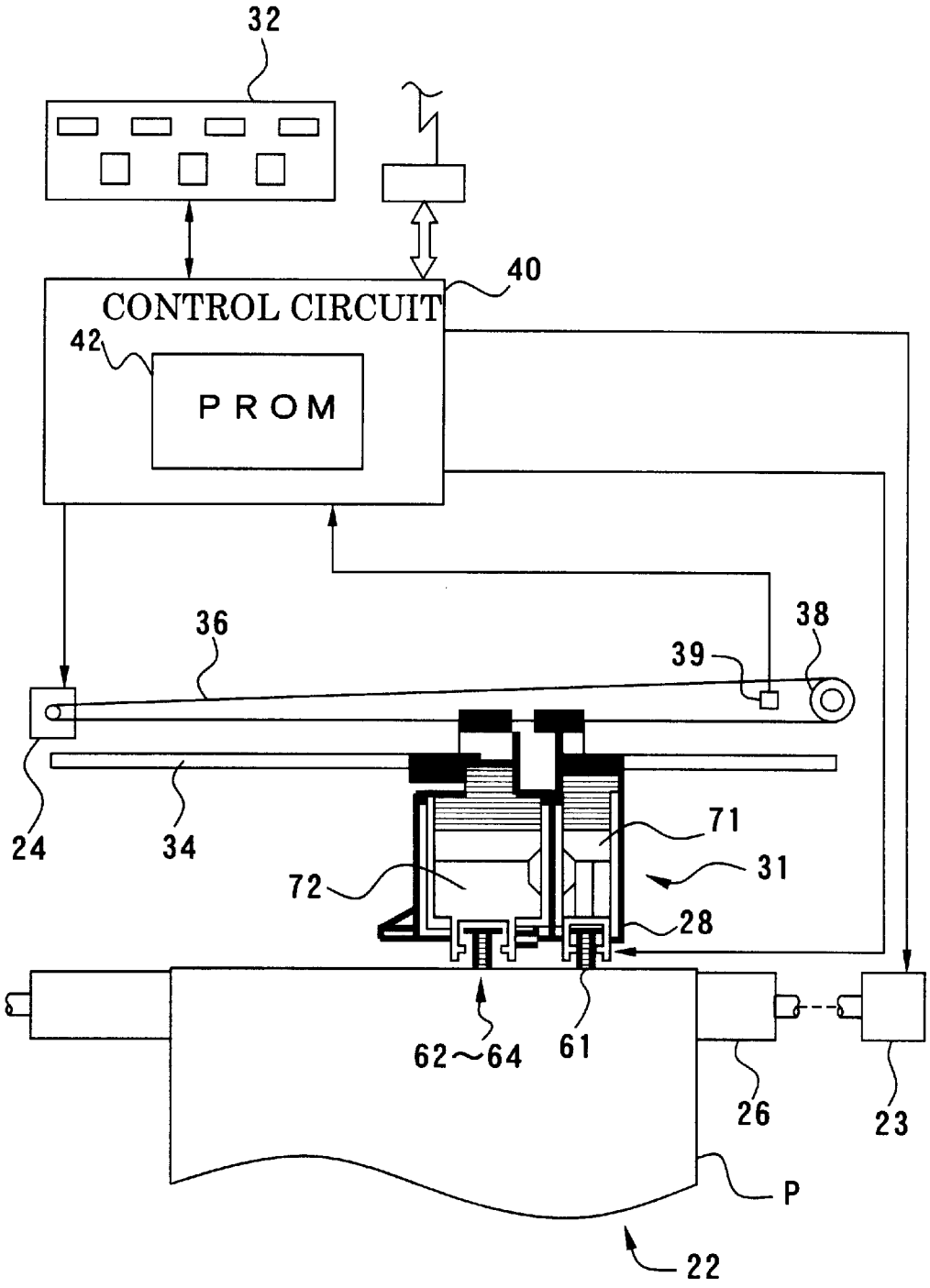
FIG. 2 schematically illustrates structure of the printer 22.

FIG. 2 schematically illustrates the structure of the printer 22. The printer 22 has a mechanism for feeding a sheet of paper P by means of a sheet feed motor 23, a mechanism for reciprocating a carriage 31 along the axis of a platen 26 by means of a carriage motor 24, a mechanism for driving a print head 28 mounted on the carriage 31 to control discharge of ink and formation of dots, and a control circuit 40 for transmitting signals to and from the sheet feed motor 23, the carriage motor 24, the print head 28, and a control panel 32.

The mechanism for feeding the sheet of paper P has a gear train (not shown) that transmits rotations of the sheet feed motor 23 to the platen 26 as well as a sheet feed roller (not shown). The mechanism for reciprocating the carriage 31 includes a sliding shaft 34 arranged in parallel with the axis of the platen 26 for sidably supporting the carriage 31, a pulley 38, an endless drive belt 36 spanned between the carriage motor 24 and the pulley 38, and a position sensor 39 that detects the position of the origin of the carriage 31.

A black ink cartridge 71 and a color ink cartridge 72 for storing three color inks, that is, cyan, magenta, and yellow, may be mounted on the carriage 31 of the printer 22. Four ink discharge heads 61 through 64 are formed on the print head 28 that is disposed in the lower portion of the carriage 31, and ink supply conduits 65 (see FIG. 3) are formed in the bottom portion of the carriage 31 to feed supplies of ink from ink tanks to the respective ink discharge heads 61 through 64. When the black ink cartridge 71 and the color ink cartridge 72 are attached downward to the carriage 31, the ink supply conduits 65 are inserted into connection apertures (not shown) formed in the respective cartridges. This enables supplies of ink to be fed from the respective ink cartridges to the ink discharge heads 61 through 64.

Figure 3:
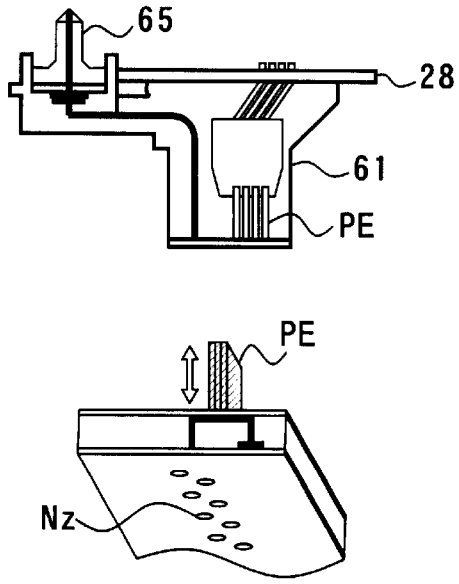
FIG. 3 illustrates structure of a print head 28 in the printer 22.

The following briefly describes the mechanism of discharging ink. When the ink cartridges 71 and 72 are attached to the carriage 31, supplies of ink in the ink cartridges 71 and 72 are sucked out by capillarity through the ink supply conduits 65 and are led to the ink discharge heads 61 through 64 formed in the print head 28 arranged in the lower portion of the carriage 31 as shown in FIG. 3. In case that the ink cartridges 71 and 72 are attached to the carriage 31 for the first time, a pump works to suck first supplies of ink into the respective ink discharge heads 61 through 64. In this embodiment, structures of the pump for suction and a cap for covering the print head 28 during the suction are not illustrated nor described specifically.

Figure 4:
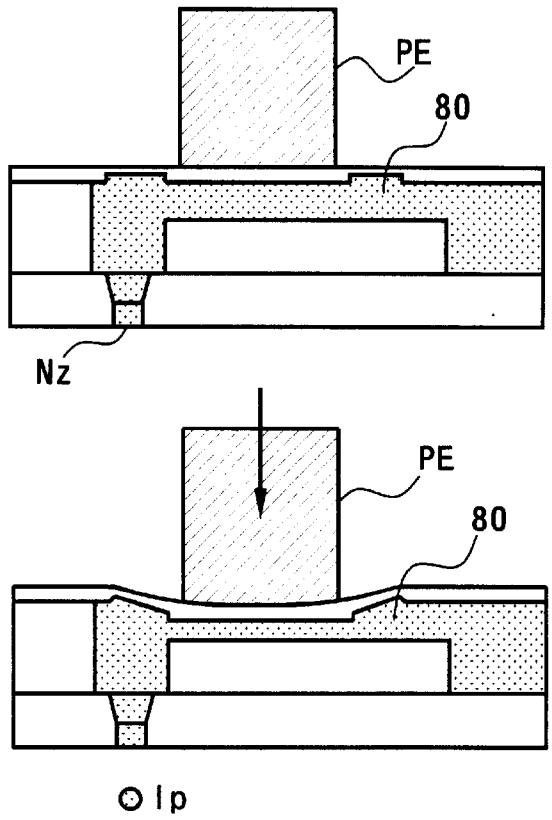
FIG. 4 shows a principle of dot formation in the printer 22 of the embodiment.
Figure 5:
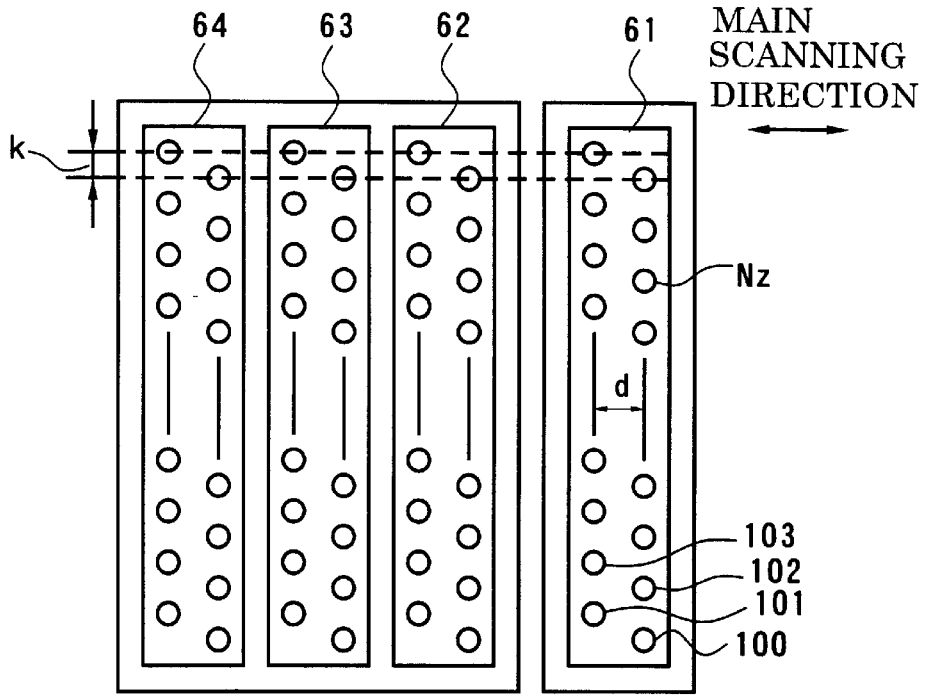
FIG. 5 shows an arrangement of nozzle arrays formed on the print head 28.

An array of thirty-two nozzles Nz is formed in each of the ink discharge heads 61 through 64 as shown in FIG. 5. A piezoelectric element PE, which has an excellent response and is one of electrically distorting elements, is arranged for each nozzle Nz. FIG. 4 illustrates a configuration of the piezoelectric element PE and the nozzle Nz. The piezoelectric element PE is disposed at a position that comes into contact with an ink conduit 80 for leading ink to the nozzle Nz. As is known, the piezoelectric element PE has a crystal structure that is subjected to a mechanical stress due to application of a voltage and thereby carries out extremely high-speed conversion of electrical energy to mechanical energy. In this embodiment, application of a voltage between electrodes on either ends of the piezoelectric element PE for a predetermined time period causes the piezoelectric element PE to extend for the predetermined time period and deform one side wall of the ink conduit 80 as shown in the lower drawing of FIG. 4. The volume of the ink conduit 80 is reduced with an extension of the piezoelectric element PE, and a certain amount of ink corresponding to the reduced volume is sprayed as an ink particle Ip from the end of the nozzle Nz at a high speed. The ink particles Ip soak into the sheet of paper P set on the platen 26, so as to carry out printing.

FIG. 5 shows an arrangement of ink jet nozzles in the ink discharge heads 61 through 64. The first head 61 has a nozzle array for spouting black ink. Similarly the second through the fourth heads 62 through 64 respectively have nozzle arrays for spouting cyan, magenta, and yellow inks. These four nozzle arrays occupy identical positions in the sub-scanning direction.

Each of the four nozzle arrays includes thirty-two nozzles Nz arranged in zigzag at a constant nozzle pitch k in the sub-scanning direction. Thirty-two nozzle Nz included in each nozzle array may be arranged in alignment, instead of in zigzag. The zigzag arrangement as shown in FIG. 5, however, has the advantage of allowing a smaller nozzle pitch k to be set in the manufacturing process.

Figure 6:
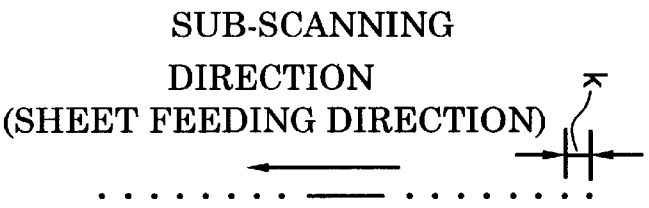
FIG. 6 shows an arrangement of dots formed by one nozzle array.

FIG. 6 shows an arrangement of a plurality of dots formed by one nozzle array. In this embodiment, whether the ink nozzles are arranged in zigzag or in alignment, driving signals are supplied to the piezoelectric elements PE (FIGS. 3 and 4) of the respective nozzles, in order to cause a plurality of dots formed by one nozzle array to be arranged substantially in alignment in the sub-scanning direction. By way of example, it is assumed that the nozzle array has nozzles arranged in zigzag as shown in FIG. 5 and that the head 61 is scanned rightward in the drawing to form dots. In this case, a group of preceding nozzles 100, 102, . . . receive driving signals at an earlier timing by d/v [second] than a group of following nozzles 101, 103 . . . In the drawing of FIG. 5, d [inch] denotes the pitch between the two nozzle groups in the head 61, and v [inch/second] denotes the scanning speed of the head 61. A plurality of dots formed by one nozzle array are accordingly arranged substantially in alignment in the sub-scanning direction. All the thirty-two nozzles formed in each of the heads 61 through 64 are not always used, but only part of the nozzles may be used according to the dot printing technique.

As shown in FIG. 2, the control circuit 40 includes a programmable ROM (PROM) 42, which is a rewritable non-volatile memory, other than a CPU and main memories (a ROM and a RAM), which are not specifically illustrated herein. In the printer 22 of the embodiment, the print mode is switched between a single-way printing mode, in which dots are created only during forward motions of the carriage 31, and a dual-way printing mode, in which dots are created during both forward and backward motions of the carriage 31. Mode specification information which specifies a selected mode is stored in the PROM 42. Plural pieces of dot printing mode information, for example, information on the print timing at which dots are created in the dual-way printing mode, are also stored in the PROM 42. At the time of activating the computer 90, the printer driver 96 reads the dot printing mode information from the PROM 42. Main scans and sub-scans are carried out according to the dot printing mode information.

The PROM 42 may be any rewritable non-volatile memory and is, for example, an EEPROM or a flash memory. The dot printing mode information may be stored in the non-rewritable ROM, although it is preferable that the mode specification information is stored in the rewritable non-volatile memory. The plural pieces of dot printing mode information may be stored in a storage device other than the PROM 42 or alternatively in the printer driver 96.

In the printer 22 of the embodiment having the hardware structure discussed above, while the sheet feed motor 23 rotates the platen 26 and the other related rollers to feed the sheet of paper P (hereinafter referred to as the sub-scan), the carriage motor 24 drives and reciprocates the carriage 31 (hereinafter referred to as the main scan), simultaneously with actuation of the piezoelectric elements PE on the respective ink discharge heads 61 through 64 of the print head 28. The printer 22 accordingly sprays the respective color inks to create dots and thereby forms a multi-color image on the sheet of paper P.

(2) Adjustment of Dot Print Timing in Dual-way Printing Mode

The following describes a method of adjusting the dot print timing when the printer 22 is set in the dual-way printing mode. When an instruction is given to carry out printing in an adjustment mode through operation of the input unit 92, the computer 90 causes the printer 22 to print a test pattern stored in the ROM via the printer driver 96. The process of printing the test pattern is similar to the process of printing the image information described above. Part of the test pattern is formed during a forward motion of the carriage 31, whereas the residual part is formed during a backward motion of the carriage 31. Although the printer 22 of the embodiment can print color images, the test pattern is printed in a single color, i.e., black, since monochromatic printing is sufficient for adjustment of the dot print timing.

Figure 7:
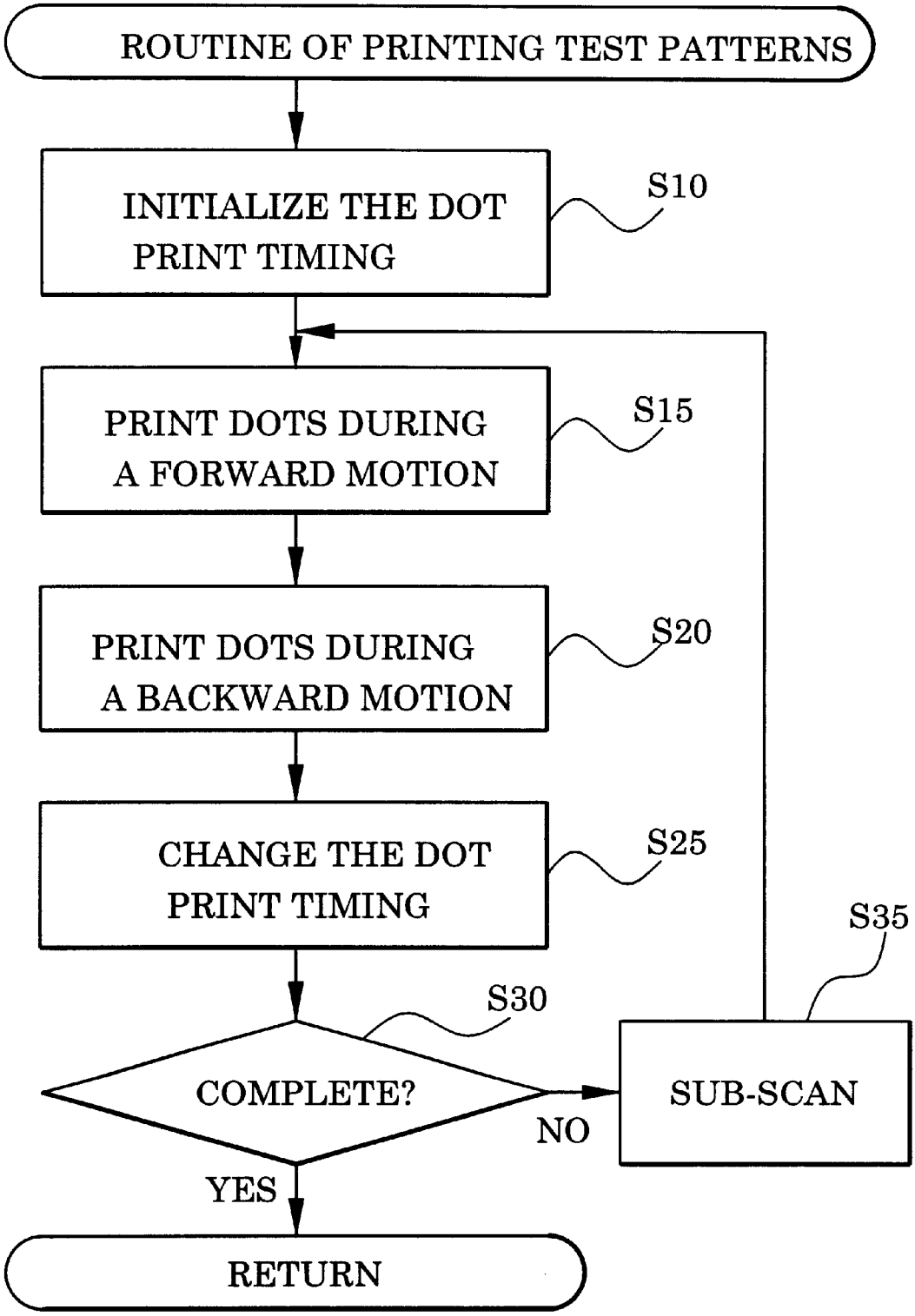
FIG. 7 is a flowchart showing a routine of printing test patterns.

In order to adjust the dot print timing in the dual-way printing mode, the computer 90 prints the test patterns while varying the dot printing timing during the backward motions of the carriage 31. FIG. 7 is a flowchart showing a routine of printing test patterns. The computer 90 first initializes the dot print timing at step S10,and print dots during the forward motion at step S15. Next the computer 90 prints dots during the backward motion at step S20, and changes the dot print timing at step S25. The dot print timing is stored in the PROM 42 of the printer 22 as mentioned above, and the printer driver 96 reads the dot print timing from the PROM 42 at the time of activating the computer 90. Unless printing test patterns are completed at step S30, the computer 90 sub-scans at step S35 and prints dots during the forward motion again. The computer 90 prints the test patterns at the specified dot print timing for the dual-way printing mode and at the varied dot print timings that are quickened and delayed from the specified dot print timing in a predetermined range. A symbol that identifies each dot print timing is printed simultaneously in the vicinity of each test pattern printed at each dot print timing.

The user of the printer 22 compares the plurality of test patterns printed in the above manner and selects the test pattern of the optimum image. The symbol printed in the vicinity of the selected test pattern is input into the computer 90 through operation of the input unit 92. The printer driver 96 then causes the printer 22 to carry out a printing operation at the dot print timing corresponding to the input symbol. This completes adjustment of the dot print timing of the printer 22. The newly specified dot print timing is stored into the PROM 42 of the printer 22. Since this piece of information is not erased by a power-off operation, it is not required to adjust the dot print timing frequently.

Adjustment of the dot print timing is not restricted to this method. Another available technique repeatedly inputs the dot print timing and prints the test pattern at the input dot print timing, so as to update the dot print timing successively to the optimum state. The functions corresponding to the printer driver 96 and the input unit 92 of the computer 90 may be incorporated into the printer 22. In this case, the printer 22 can adjust the dot print timing independently.

(3) Test Patterns Based on Normal Dither Matrix

Figure 8:
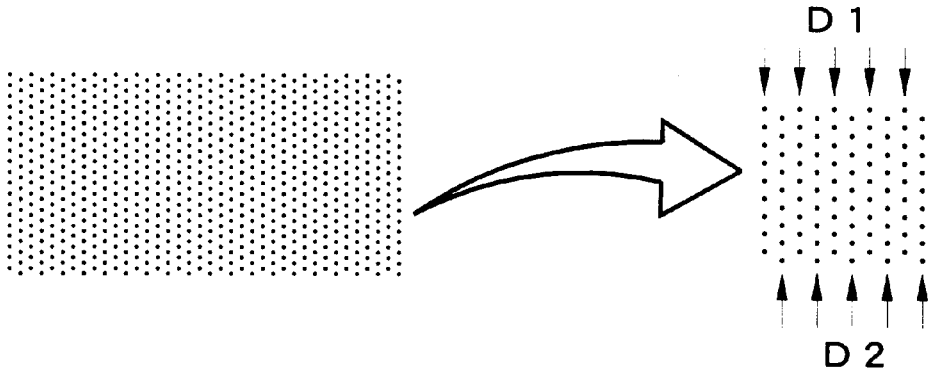
FIG. 8 shows a test pattern of a normal dither matrix formed at an appropriate print timing.
Figure 9:
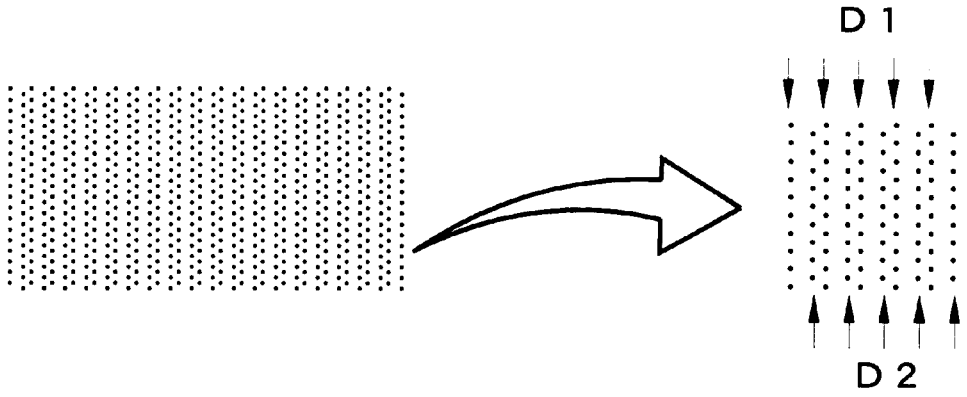
FIG. 9 shows a test pattern of the normal dither matrix formed at a deviated print timing.
Figure 10:
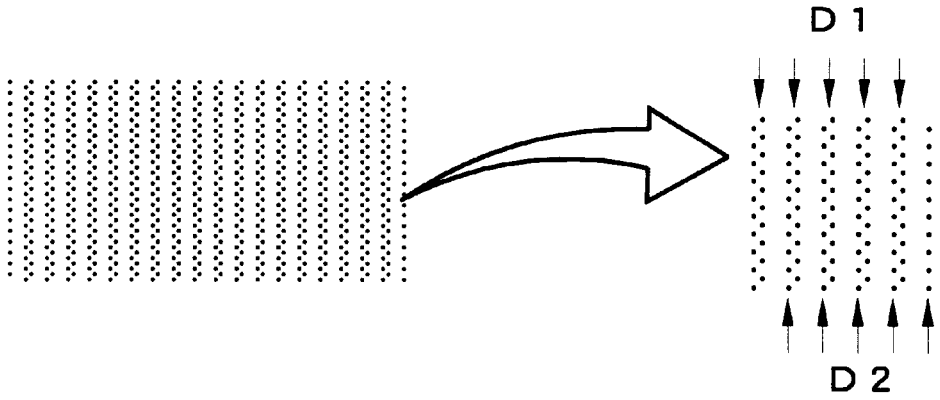
FIG. 10 shows a test pattern of the normal dither matrix formed at a further deviated print timing.
Figure 11:
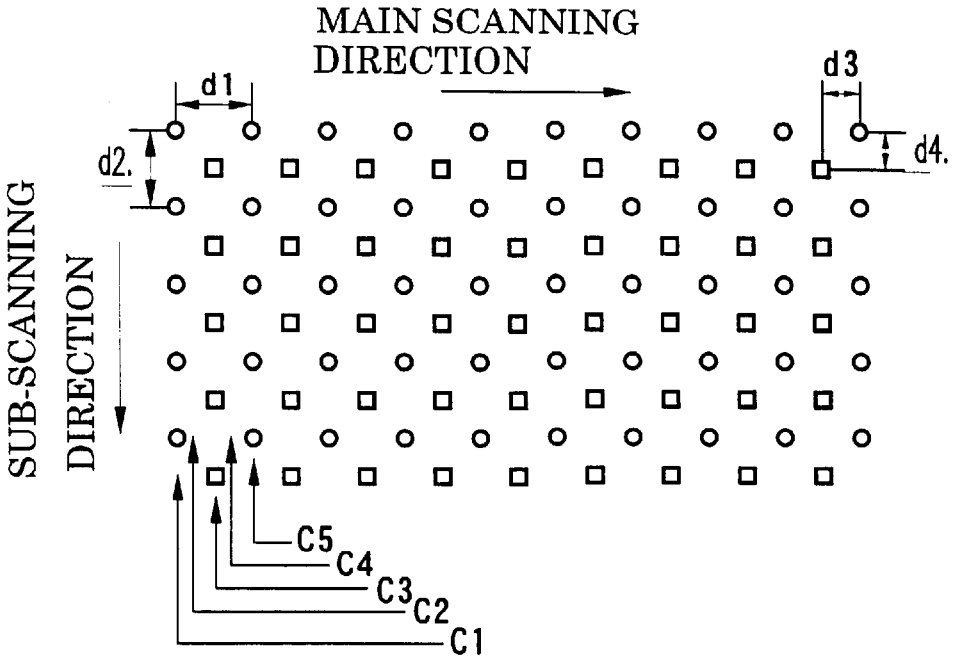
FIG. 11 shows a first example of the normal dither matrix.

FIGS. 8 through 10 show test patterns formed by the printer 22 of the embodiment. The printer 22 of the embodiment prints a plurality of dots arranged to form a normal dither matrix as the test pattern. The normal dither matrix is a pattern, in which dots are arranged regularly both in the main scanning direction and in the sub-scanning direction. FIG. 11 is an enlarged view illustrating a concrete example of the test pattern. This test pattern is printed at the optimum dot print timing. In the drawing of FIG. 11, circles represent the dots created by the forward motion of the carriage 31, whereas squares represent the dots created by the backward motion of the carriage 31. An interval d1 between the adjoining dots in the main scanning direction created by either one of the forward motion and the backward motion of the carriage 31 is identical with an interval d2 between the adjoining dots in the sub-scanning direction created by either one of the forward motion and the backward motion of the carriage 31, and coincides with the nozzle pitch k discussed in FIG. 6. An interval d3 between the adjoining dots in the main scanning direction respectively created by the forward motion and the backward motion of the carriage 31 is identical with an interval d4 between the adjoining dots in the sub-scanning direction respectively created by the forward motion and the backward motion of the carriage 31, and coincides with half the nozzle pitch k (k/2). Namely the test pattern includes a plurality of dots that are arranged regularly and apart from one another by the distance of k/2 both in the main scanning direction and in the sub-scanning direction.

FIGS. 8 through 10 show the test patterns printed at different dot print timings. These drawings are also enlarged views, and the test pattern actually formed has finer dots arranged at narrower intervals. FIG. 8 shows the test pattern formed at the optimum dot print timing. The dot print timing is varied in the sequence of FIGS. 8, 9, and 10. The right-side views show enlarged parts of the respective test patterns. Dots D1 specified by the downward arrows are created during a forward motion of the carriage 31 (hereinafter referred to as the forward-course dots D1), and dots D2 specified by the upward arrows are created during a backward motion of the carriage 31 (hereinafter referred to as the backward-course dots D2).

In the test pattern shown in FIG. 8, the forward-course dots D1 and the backward-course dots D2 are arranged regularly at a fixed interval, so that the whole test pattern is observed as a homogeneous state with no unevenness of the density. The interval between the forward-course dots D1 and the backward-course dots D2 in the main scanning direction is equal to k/2 as mentioned previously. In the test pattern of FIG. 9, on the other hand, the backward-course dots D2 are shifted a little rightward in the drawing. The interval between the forward-course dots D1 and the backward-course dots D2 in the main scanning direction is greater than k/2 on the left side of the backward-course dots D2 and is less than k/2 on the right side of the backward-course dots D2. The bias of the dot intervals causes unevenness of the density in the test pattern of FIG. 9. In the test pattern of FIG. 10, the backward-course dots D2 are further shifted rightward, and the interval between the forward-course dots D1 and the backward-course dots D2 in the main scanning direction is further biased. This results in greater unevenness of the density in the test pattern of FIG. 10, compared with that of FIG. 9.

Figure 46:
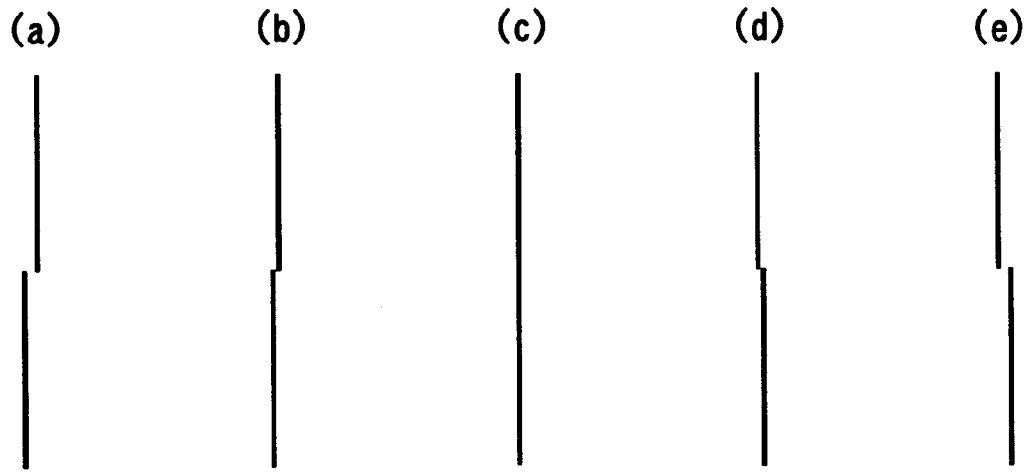
Fig.46 Prior Art
FIG. 46 shows a conventional test pattern.

The test pattern based on the normal dither matrix is printed at a variety of dot print timings. The dot print timing of the printer 22 is adjusted by selecting the test pattern that has least unevenness of the density and is printed most homogeneously. This method detects the deviation of the dot print timing as the difference in density of the test pattern printed in a given area. The vision of the human being is sensitive to such unevenness of the density. The test pattern of the embodiment enables the deviation of the dot print timing to be detected more readily and accurately, compared with the conventional line test pattern shown in FIG. 46.

Figure 12:
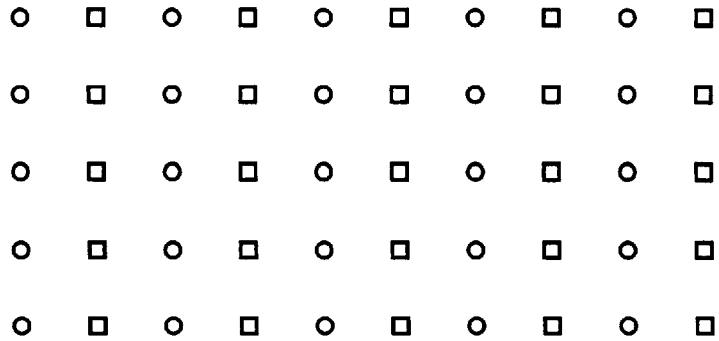
FIG. 12 shows a second example of the normal dither matrix.

The test pattern is not specifically restricted but may have any arrangement as long as the test pattern can be observed as a substantially homogeneous state without any unevenness of the density when it is printed at the appropriate dot print timing. By way of example, the test pattern of FIG. 12 or the test pattern of FIG. 13 may be adopted instead of the test pattern of FIG. 11 discussed above. In the test pattern of FIG. 12, the forward-course dots are arranged regularly at the interval d1 in the main scanning direction and at the interval d2 in the sub-scanning direction. The interval d1 is double the interval d2 in the test pattern of FIG. 12, whereas the interval d1 is equal to the interval d2 in the test pattern of FIG. 11. In the test pattern of FIG. 12, like the forward-course dots, the backward-course dots are arranged regularly at the interval d1 in the main scanning direction and at the interval d2 in the sub-scanning direction. The interval between the forward-course dots and the backward-course dots is equal to d1/2 in the main scanning direction and equal to zero in the sub-scanning direction. This means that the forward-course dots and the backward-course dots are aligned at the same position in the sub-scanning direction. The interval d1/2 is equal to the interval d2. When this test pattern is printed at the appropriate dot print timing, the dots are regularly arranged at the interval d2 as shown in FIG. 12 and observed as a substantially homogeneous state without any unevenness of the density. The main scanning direction and the sub-scanning direction may be exchanged in the test pattern of FIG. 12. In other words, the test pattern of FIG. 12 may be rotated by 90 degrees.

Figure 13:
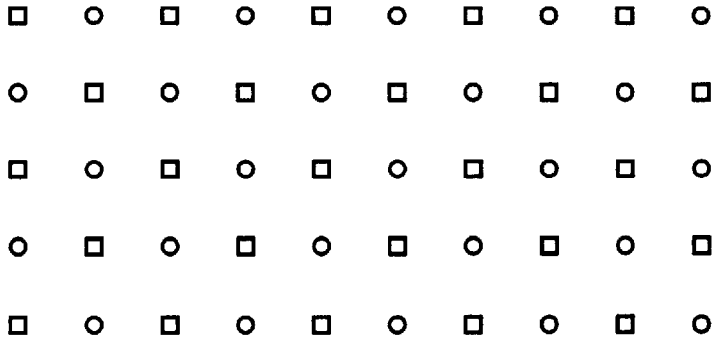
FIG. 13 shows a third example of the normal dither matrix.

The difference of the test pattern shown in FIG. 13 from the test pattern shown in FIG. 12 is that both the forward-course dots and the backward-course dots are arranged in zigzag. When this test pattern is printed at the appropriate dot print timing, the dots are regularly arranged at the interval d2 as shown in FIG. 13 and observed as a substantially homogeneous state without any unevenness of the density.

In all these examples of FIGS. 10 through 12, the dots are uniformly arranged at a fixed interval both in the main scanning direction and in the sub-scanning direction when the test pattern is printed at the appropriate dot print timing. It is, however, not essential to arrange the dots at a fixed interval in both the directions. The only requirement is that the dots are arranged uniformly at a fixed interval in each scanning direction. By way of example, in the test pattern of FIG. 11, the interval d1 in the main scanning direction may be different from the interval d2 in the sub-scanning direction. In this case, one of the interval d1 in the main scanning direction and the interval d2 in the sub-scanning direction may be several times the other. In another example, the interval d1 in the main scanning direction and/or the interval d2 in the main scanning direction may be different from the nozzle pitch k.

The printer 22 of this embodiment may print the test pattern shown in FIG. 11 at the interval d1 in the main scanning direction and at the interval d2 in the sub-scanning direction, which respectively realize the spatial frequency of 1 cycle/mm. The spatial frequency represents the frequency of a variation in density of the printed test pattern. In the test pattern of FIG. 11, the area in which the forward-course dots are created and the area in which the backward-course dots are created correspond to dark portions, whereas the area in which no dots are created corresponds to a light portion. As mentioned previously, in the specification hereof, the light portion implies both the area in which no dots are formed and the area that has a low density of dots. For example, the test pattern of FIG. 11 is observed successively in the main scanning direction from the forward-course dots printed on the left most column (column c1 in FIG. 11). The column c1, on which the forward-course dots are formed, is a dark column, and the immediate right-hand column (column c2) of c1 is a light column. The right-hand column (column c3) of c2 on which the backward-course dots are formed is a dark column, and the right-hand column (column c4) of c3 is a light column. The density is changed twice in the range from the forward-course dots printed on the column c1 to the next forward-course dots printed on a column c5. Taking into account the case in which the dot print timing is deviated as shown in FIG. 9, the density change has a cycle of two variations appearing in the interval d1 between a certain column of the forward-course dots and a next column of the forward-course dots. When the interval d1 in the main scanning direction is 1 mm, the spatial frequency in the main scanning direction is equal to 1 cycle/mm. Similarly in the examples of FIGS. 11 and 12, when the interval d1 in the main scanning direction is 1 mm, the spatial frequency in the main scanning direction is equal to 1 cycle/mm.

Figure 14:
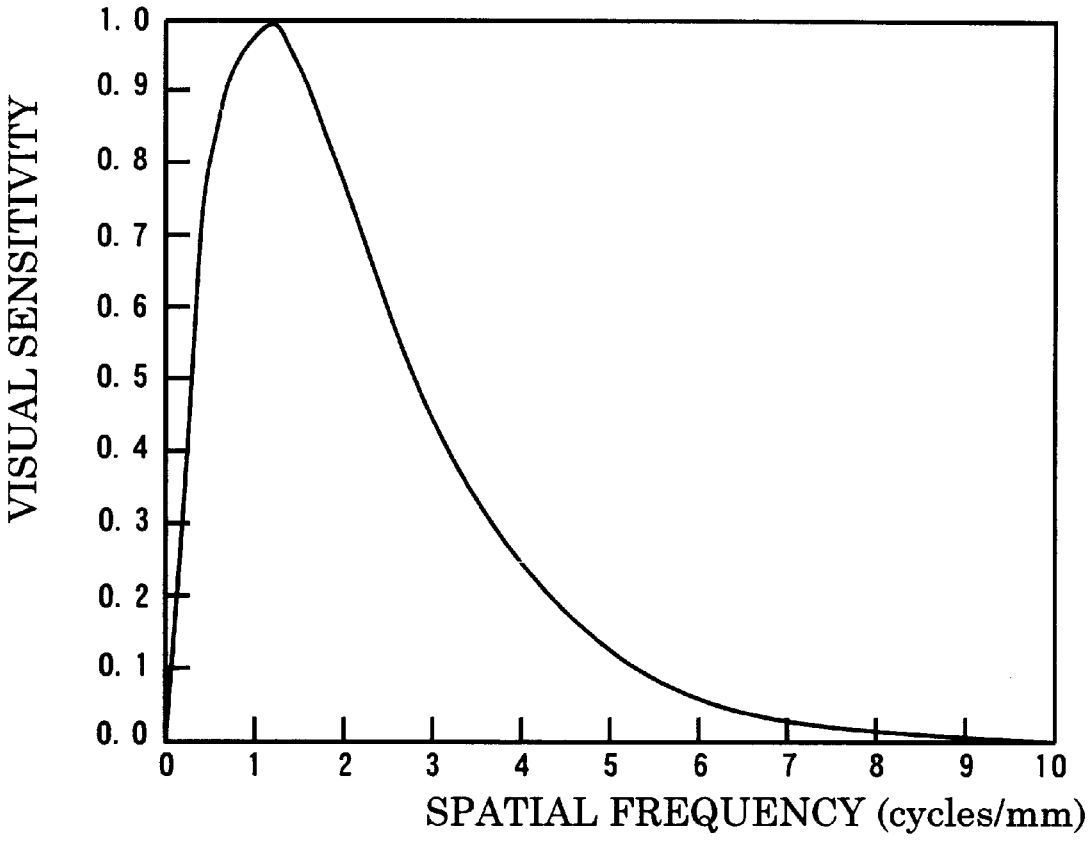
FIG. 14 is a graph showing the visual sensitivity plotted against the spatial frequency.

It is generally known that the visual sensitivity of the human being to the noise of a printed image varies with a variation in spatial frequency. This relationship is shown in the graph of FIG. 14. The curve of the visual sensitivity-spatial frequency characteristics is known as the visual transfer function (VTF), where the spatial frequency is plotted as abscissa and the visual sensitivity at each spatial frequency as ordinate. The graph shows that the visual sensitivity is relatively high at the spatial frequency in the range of 0.4 to 2.0 cycles/mm and has a maximum at the spatial frequency of approximately 1 cycle/mm. The test patterns of the above examples are printed at this spatial frequency, so that unevenness of the density due to a deviation of the dot print timing is observable with a high sensitivity. This accordingly enables the dot print timing to be adjusted accurately.

Adjustment of the dot print timing eliminates a possible deviation occurring in the main scanning direction, so that the spatial frequency giving a high visual sensitivity only in the main scanning direction may be selected. By way of example, the interval d1 in the main scanning direction is set equal to 1 mm from the viewpoint of the spatial frequency, whereas the interval d2 in the sub-scanning direction coincides with the nozzle pitch k from the viewpoint of efficient formation of the test pattern.

Figure 15:
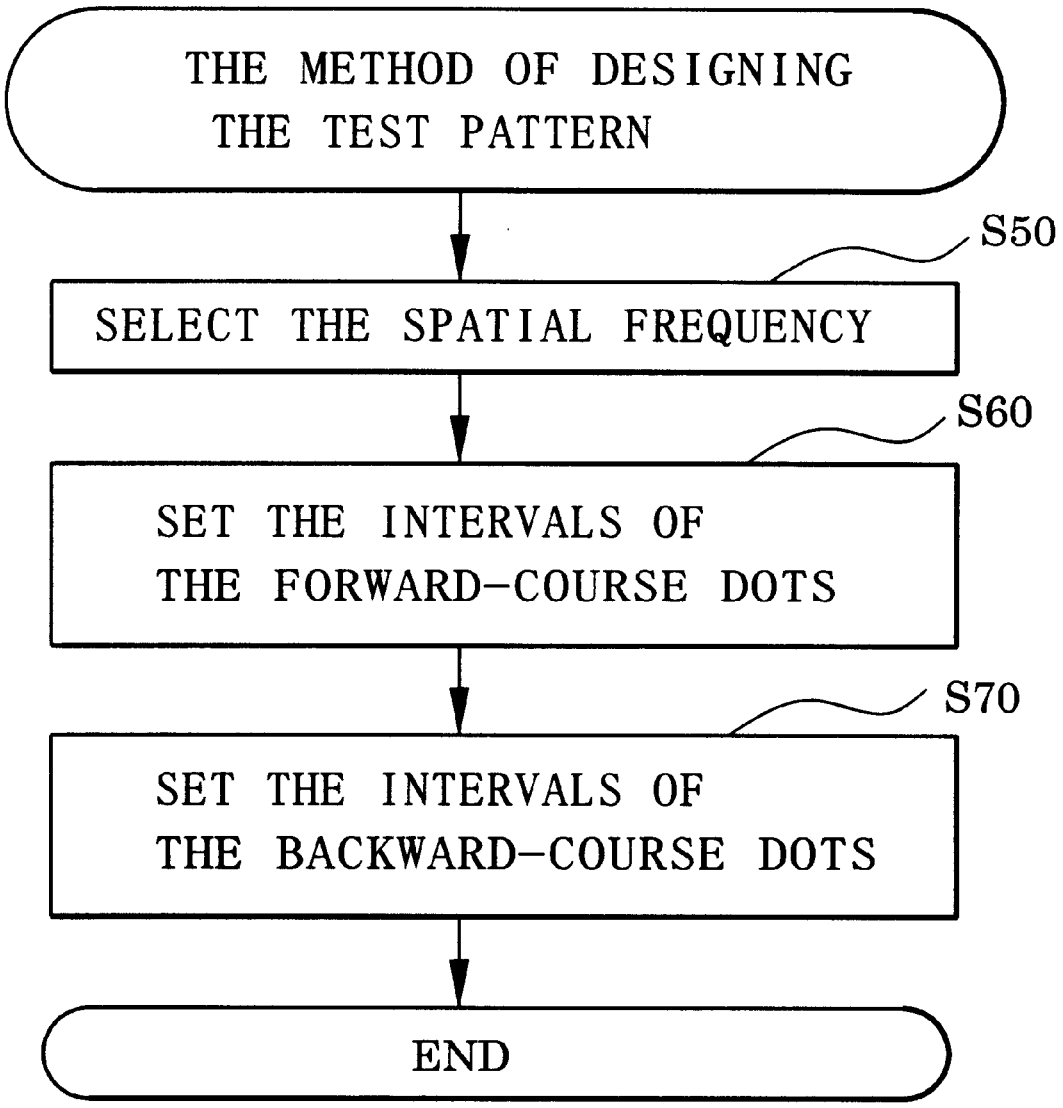
FIG. 15 is a flowchart showing a method of designing a test pattern.

The following describes the method of designing the test pattern by taking into account a variation in visual sensitivity against the spatial frequency. FIG. 15 is a flowchart showing a method of designing a test pattern. As clearly understood from the graph of FIG. 14, the visual sensitivity is relatively high in the range of the spatial frequency of 0.4 to 2.0 cycles/mm. The spatial frequency of the test pattern is accordingly selected in this range at step S50. Here it is not necessary to select the spatial frequency of approximately 1 cycle/mm that gives the maximum visual sensitivity. The spatial frequency giving sufficient visual sensitivity should be selected according to the adjustment accuracy of the target dot print timing. The reciprocal of the selected spatial frequency is set to the intervals of the forward-course dots (d1 and d2 in the example of FIG. 11) in the test pattern at step S60. In case that the visual sensitivity with respect to the lightness in the vertical direction is different from that in the lateral direction, the intervals d1 and d2 may be set separately according to the spatial frequencies that respectively give the high visual sensitivities. The intervals of the backward-course dots (d3 and d4 in the example of FIG. 11) are set to satisfy at least one of the following relations at step S70: d3=d1/2 and d4=d2/2. This results in designing a favorable test pattern.

The test pattern thus designed is sufficiently applied to adjust the dot print timing. In the printer 22 of this embodiment with a plurality of nozzles formed on the head as shown in FIG. 5, the interval d2 in the sub-scanning direction may be coincident with an integral multiple of the nozzle pitch k or the reciprocal of the integral multiple. This enables the test pattern to be formed efficiently at the spatial frequency giving high visual sensitivity. The interval d1 in the main scanning direction may further be made coincident with the interval d2 in the sub-scanning direction. This structure ascertains the uniformity of the test pattern both in the main scanning direction and in the sub-scanning direction. As discussed above, the test pattern can be designed according to the adjustment accuracy of the target dot print timing by taking into account the relationship between the spatial frequency and the visual sensitivity.

Some examples of test pattern printing sheets used for the printer 22 are shown in FIGS. 14 through 17. These test pattern printing sheets are used to facilitate the accurate adjustment of the dot print timing in the printer 22 of the embodiment. Test patterns, which are formed at the optimum timing (corresponding to FIG. 8), are printed in advance at a predetermined interval along the left and right ends of the test pattern printing sheet shown in FIG. 16. The printer 22 of the embodiment prints a test pattern in a dot printing area that exists on the central portion of the test pattern printing sheet. Using this test pattern printing sheet allows direct comparison of the currently printed test pattern with the pre-printed test patterns, thereby enabling the dot print timing to be adjusted relatively easily at a high accuracy. The test pattern printing sheet enables even an unskilled user of the printer who is unfamiliar with the test patterns to easily and accurately adjust the dot print timing.

Figure 16:
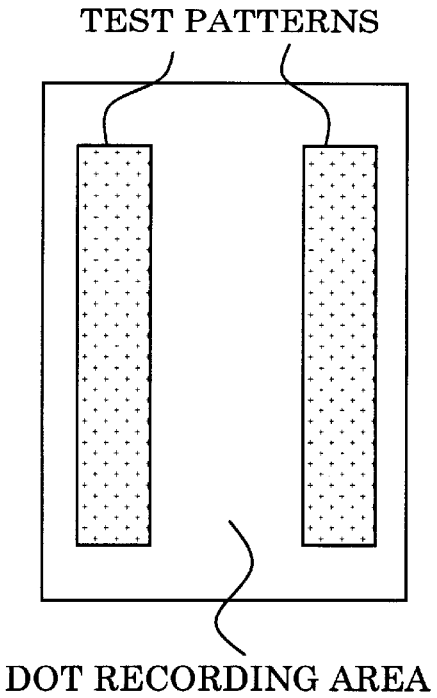
FIG. 16 shows a first example of a test pattern printing sheet.
Figure 17:
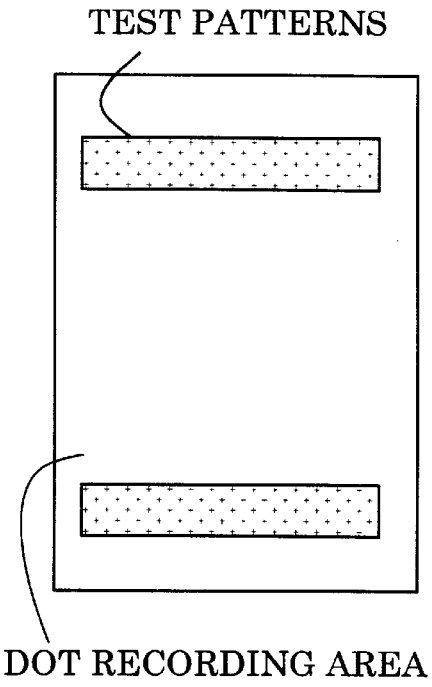
FIG. 17 shows a second example of the test pattern printing sheet.
Figure 18:
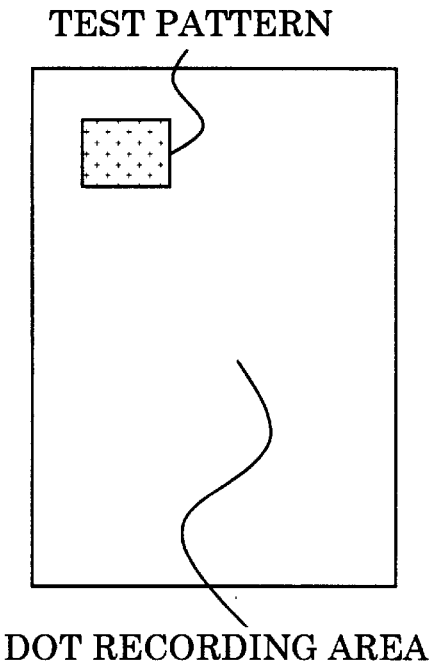
FIG. 18 shows a third example of the test pattern printing sheet.
Figure 19:
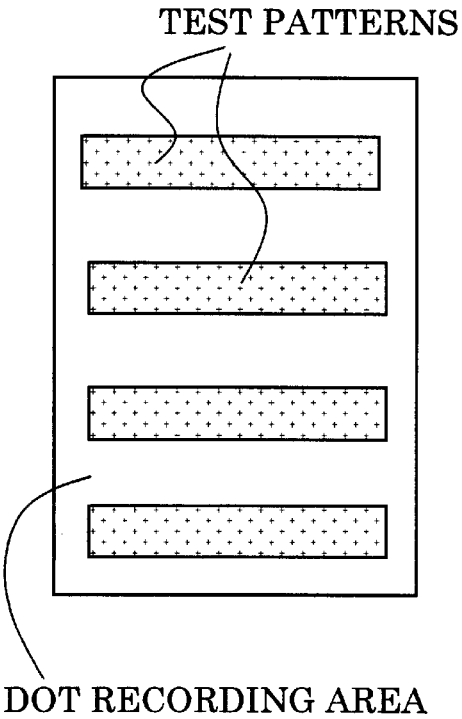
FIG. 19 shows a fourth example of the test pattern printing sheet.

Arrangement of the pre-printed test patterns is not restricted to the example shown in FIG. 16, but may be any form that allows direct comparison of a currently printed test pattern with the pre-printed test patterns. Other available examples include an arrangement of pre-printed test patterns along upper and lower ends of the printing sheet as shown in FIG. 17, an arrangement of a pre-printed test pattern at a predetermined position in the printing sheet as shown in FIG. 18, and an arrangement of pre-printed test patterns at predetermined intervals in the sub-scanning direction as shown in FIG. 19. The pre-printed test pattern may partly overlap the test pattern currently printed by the printer 22, as long as a non-overlapped area exists. For example, in the case of the printing sheet shown in FIG. 19, misalignment of the printing sheet on the platen 26 of the printer 22 may cause an overlap of the currently printed test pattern with the pre-printed test pattern. There is, however, still a non-overlapped portion because of the arrangement of the pre-printed test patterns at the predetermined intervals in the sub-scanning direction. Any of these printing sheets can be used to adjust the dot print timing.

(4) Second Embodiment

The following describes a printer 22 as a second embodiment according to the present invention. The printer 22 of the second embodiment has the same hardware structure as that of the printer 22 of the first embodiment, and prints the same test pattern as that of the first embodiment shown in FIG. 11. The printer 22 of the second embodiment, however, applies a different method of printing a test pattern from that of the first embodiment.

The printer 22 of the second embodiment prints the normal dither matrix shown in FIG. 11 by dual-way printing, which creates dots in the course of the motions of the carriage 31 both in the forward direction and in the backward direction like the first embodiment, or by single-way printing, which creates dots only in the course of the forward motions of the carriage 31. In the case of single-way printing, all the dots shown by circles and squares in FIG. 11 are printed in the course of the forward motions of the carriage 31. There is no deviation of the dot print timing in the case of single-way printing, so that the test pattern is always printed in the optimum conditions.

Figure 23:
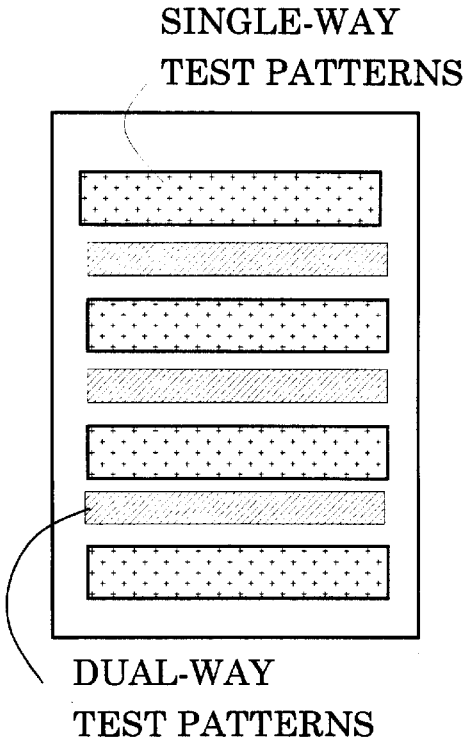
FIG. 23 shows a fourth example of the test pattern printed in the second embodiment.

In response to an instruction to print a test pattern, the printer 22 of the embodiment prints a test pattern formed by the single-way printing (hereinafter referred to as the single-way test pattern) adjacent to a test pattern formed by the dual-way printing (hereinafter referred to as the dual-way test pattern). By way of example, the single-way test patterns and the dual-way test patterns are printed to be aligned alternately in the sub-scanning direction as shown in FIG. 23. The dual-way test pattern is printed at a variety of dot print timings.

The printer 22 of this structure allows direct comparison between the single-way test pattern representing the ideal state and the currently printed test pattern, without using any one of the specific test pattern printing sheets described in the first embodiment. This structure accordingly enables the dot print timing to be adjusted relatively easily at a high accuracy. The printer of this structure enables even an unskilled user of the printer who is unfamiliar with the test patterns to easily and accurately adjust the dot print timing.

Figure 20:
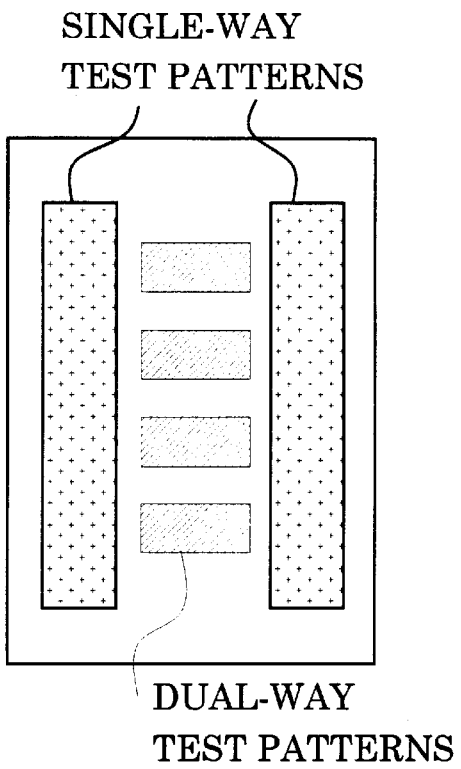
FIG. 20 shows a first example of a test pattern printed in a second embodiment according to the present invention.
Figure 21:
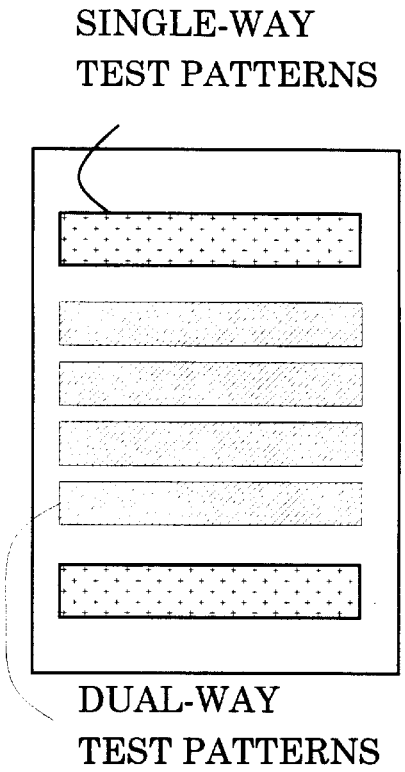
FIG. 21 shows a second example of the test pattern printed in the second embodiment.
Figure 22:
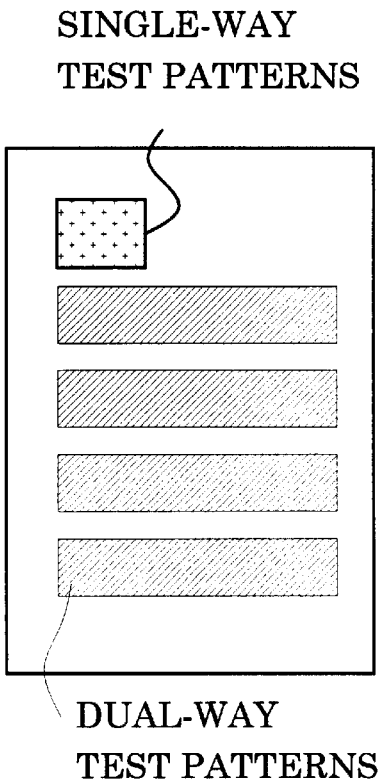
FIG. 22 shows a third example of the test pattern printed in the second embodiment.

The single-way test pattern and the dual-way test pattern may be printed at any positions that allow direct comparison therebetween. For example, the dual-way test patterns may be printed between the single-way test patterns arranged at a predetermined interval along the right end and the left end of the printing sheet as shown in FIG. 20. In another example, the dual-way test patterns may be printed between the single-way test patterns arranged at a predetermined interval along the upper end and the lower end of the printing sheet as shown in FIG. 21. In still another example, the dual-way test patterns may be printed below the single-way test pattern arranged at a predetermined position in the printing sheet as shown in FIG. 22. Although there is an interval between the single-way test pattern and the dual-way test pattern in the examples of FIGS. 18 through 21, these test patterns may be printed in contact with each other.

(5) Third Embodiment

The following describes a printer 22 as a third embodiment according to the present invention. The printer 22 of the third embodiment has the same hardware structure as that of the printer 22 of the first embodiment, but prints a different test pattern from that of the first embodiment shown in FIG. 11.

Figure 25:
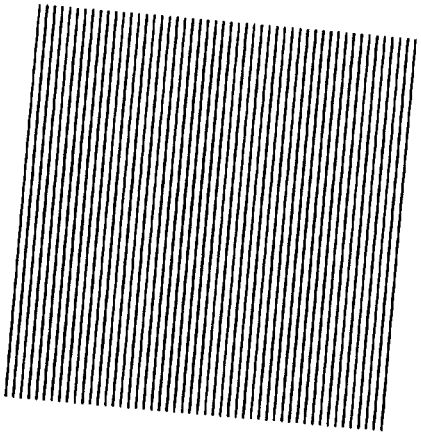
FIG. 25 shows reference lines formed in the third embodiment.
Figure 26:
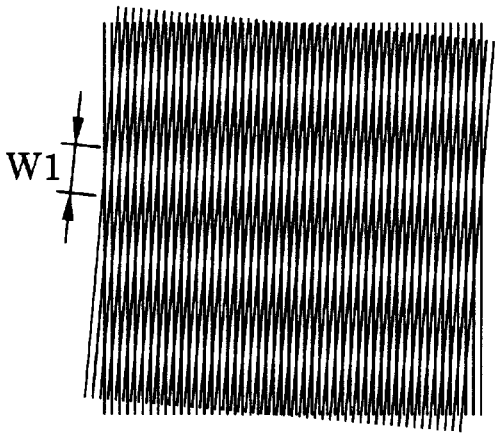
FIG. 26 shows a moire of a first test pattern formed at an appropriate print timing in the third embodiment.

The printer 22 of the third embodiment prints a test pattern that causes a moire pattern. The moire pattern denotes light-dark stripes created by the interference of parallel lines arranged at equal intervals with other dots. FIG. 26 shows an example of the moire pattern. The moire pattern shown in FIG. 26 is created by superposing oblique parallel lines shown in FIG. 25 (hereinafter referred to as the reference lines) upon vertical parallel lines shown in FIG. 24. In the description below, parallel lines created by only either one of the forward course and the backward course are referred to as reference lines, and other patterns are referred to as inspection patterns. The printing result obtained by superposing the reference lines upon the inspection pattern is called a test pattern.

Figure 24:
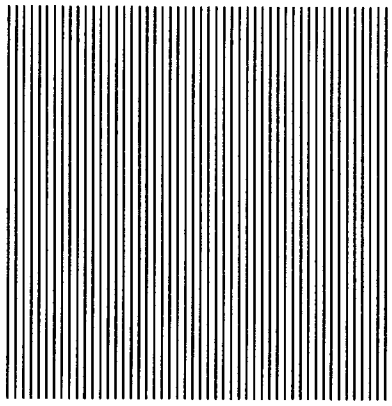
FIG. 24 shows an inspection pattern formed in a third embodiment according to the present invention.
Figure 27:
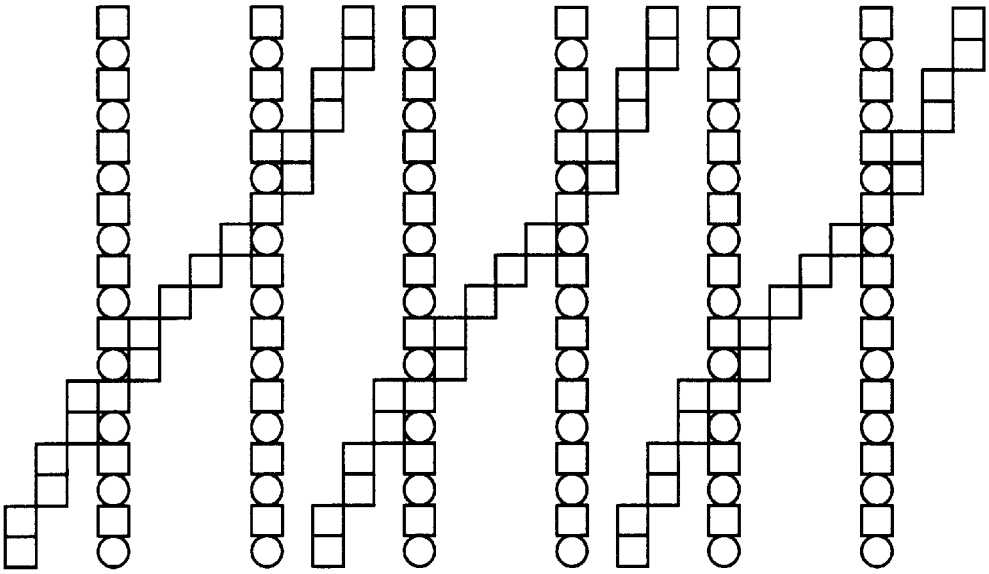
FIG. 27 is an enlarged view showing the first test pattern recorded at the optimum print timing.

In this embodiment, part of the parallel lines constituting the inspection pattern of FIG. 24 are created in the course of the forward motion of the main scan, whereas the rest are created in the course of the backward motion of the main scan. The reference lines of FIG. 25 are formed only in the course of the backward motion of the main scan. FIG. 27 is an enlarged view showing a test pattern recorded at the optimum print timing in this embodiment. In FIG. 27, circles denote the dots formed in the course of the forward motion of the main scan, whereas squares denote the dots formed in the course of the backward motion of the main scan.

The forward course of the main scan creates dots located at positions of the odd ordinal numbers in the sub-scanning direction among the dots constituting the vertical parallel lines of FIG. 24. The backward course of the main scan, on the other hand, creates dots located at positions of the even ordinal numbers in the sub-scanning direction. When these dots are printed at the appropriate timings, vertical parallel lines are created as the inspection pattern as shown in FIG. 27. The backward course of the main scan also creates dots constituting the reference lines of FIG. 25. Formation of these dots results in the moire pattern with the width W1 of the stripes shown in FIG. 26.

Figure 28:
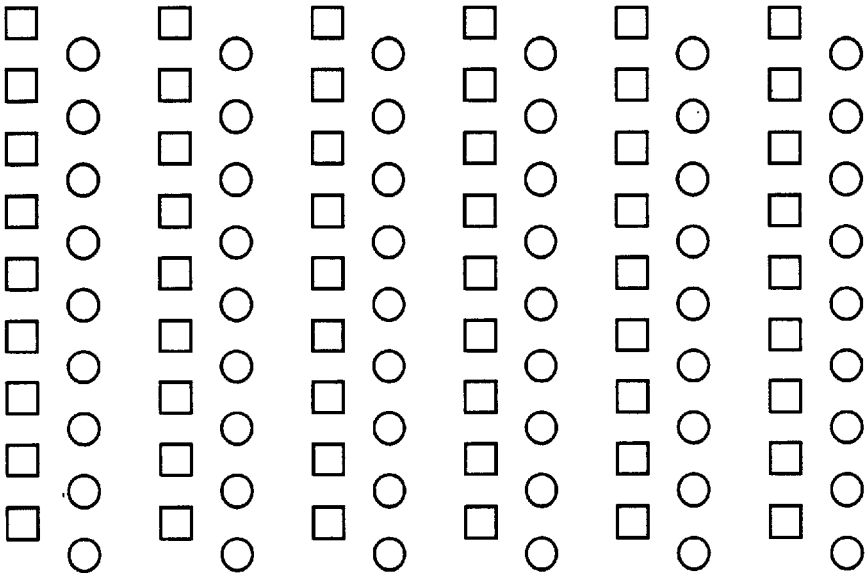
FIG. 28 is an enlarged view showing an inspection pattern formed at a deviated print timing.

FIG. 28 shows the dots created when the forward course and the backward course of the main scan have different print timings. For the clarity of illustration, only the dots corresponding to the inspection pattern of FIG. 24 are shown in FIG. 28. Deviation of the print timing of the backward course from the print timing of the forward course prevents formation of vertical parallel lines, which are supposed to be created as the inspection pattern. The reference lines, which are formed only in the course of the backward motion of the main scan, are, on the other hand, created at fixed intervals irrespective of the print timing.

Figure 29:
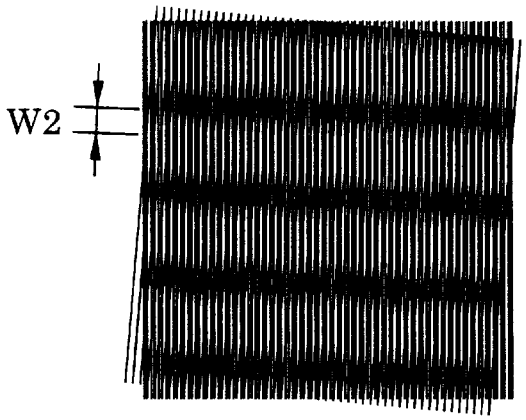
FIG. 29 shows a moire of the first test pattern formed at the deviated print timing.

FIG. 29 shows a moire pattern in case that the print timing is deviated. It is clearly understood that the width W2 of the stripes in the moire pattern of FIG. 29 is significantly different from the width W1 in the moire pattern printed at the appropriate print timing shown in FIG. 26. Even a slight deviation of the dot print timing results in a significant variation in width of the stripes in the moire pattern.

Figure 30:
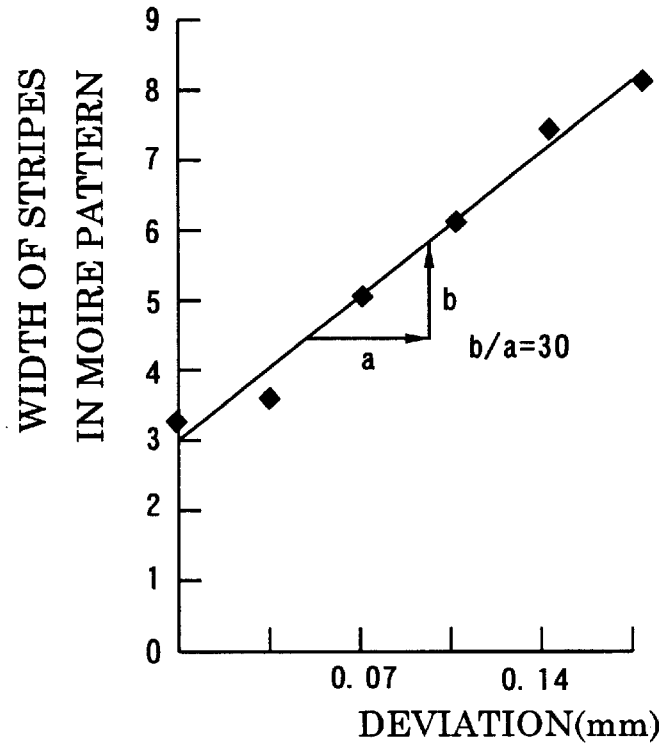
FIG. 30 is a graph showing the relationship between the deviation of the print timing and the width of the more pattern.

The graph of FIG. 30 shows a variation in width of stripes in the moire pattern plotted against the deviation of the dot print timing. In the example of FIG. 30, the intervals of the vertical parallel lines as the inspection pattern and the reference lines are both set equal to 0.7 mm, and the vertical parallel lines intersect the reference lines at the angle of 5 degrees. The deviation of the print timing is given as the deviation of the interval in the main scanning direction between the dots created in the forward course of the main scan and the dots created in the backward course at the currently specified print timing from the interval between these dots printed at the appropriate print timing. In the graph of FIG. 30, the deviation of the print timing is plotted as the abscissa, and the width of the stripes in the moire pattern as the ordinate. The deviation of the print timing is substantially proportional to the width of the stripes in the moire pattern as shown in the graph of FIG. 30. In this example, the variation in width of the moire stripes is approximately 30 times the deviation of the print timing. The relationship between the deviation of the print timing and the width of the moire stripes is varied according to the angle at which the inspection pattern intersects the reference lines. There is a tendency for the plot to deviate from the linear relationship with an increase in angle of the intersection. The results of observation of the moire patterns at various angles of the intersection show that the angle in the range of approximately 2 to 10 degrees is suitable for the adjustment of the print timing.

As discussed previously, the printer 22 of the third embodiment takes advantage of the moire of the test pattern and enables the print timings of the forward course and the backward course of the main scan to be readily adjusted at a high accuracy. A variation in moire pattern is extremely prominent, so that even an unskilled user of the printer who is unfamiliar with test patterns can adjust the print timing easily and accurately. Use of non-ink blotting special paper further improves the detection accuracy of the deviation and thereby the accuracy of adjustment of the print timing.

Figure 31:
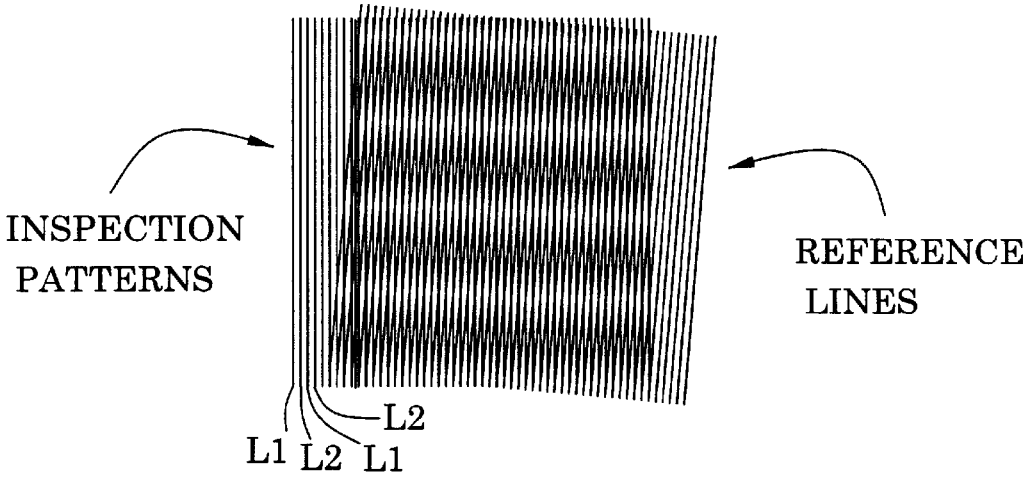
FIG. 31 shows a moire of a second test pattern formed at an appropriate print timing in the third embodiment.
Figure 32:
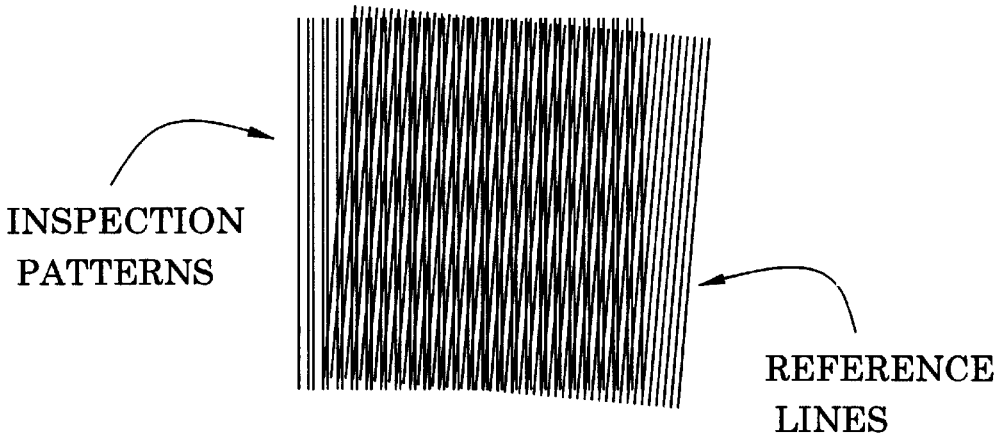
FIG. 32 shows a moire of the second test pattern formed at a deviated print timing, where the inspection pattern consists of vertical lines.

The test pattern that causes a moire pattern is not restricted to the arrangement discussed above as the third embodiment, but a variety of test patterns may be applied for the same purpose. In one example shown in FIG. 31, the inspection pattern consists of the vertical lines formed in the course of the forward motion of the main scan (shown as L1) and the vertical lines formed in the course of the backward motion of the main scan (shown as L2), which appear alternately in the main scanning direction, whereas the reference lines are oblique parallel lines. In the inspection pattern discussed in FIG. 27, each vertical line is completed by dual-way printing. In the inspection pattern of FIG. 31, on the other hand, each vertical line is completed by single-way printing. In case that the print timing is deviated, the interval between the vertical parallel lines is varied to change the moire pattern as shown in FIG. 32.

Figure 33:
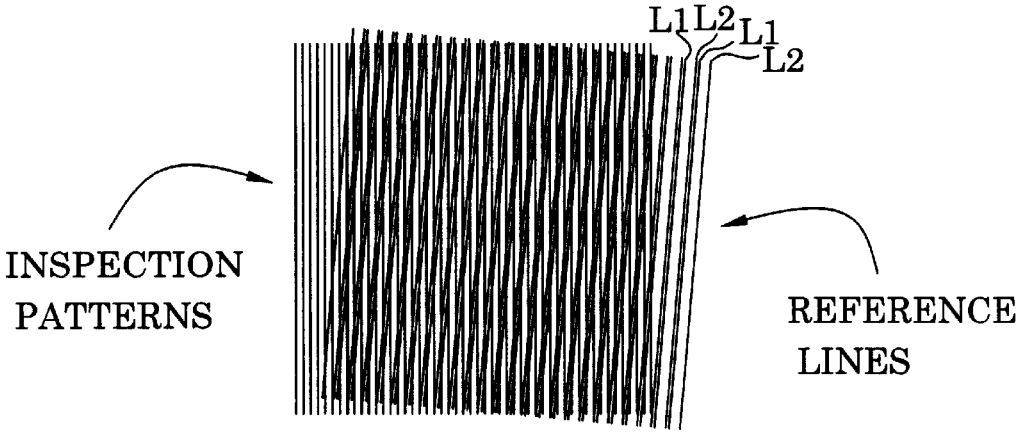
FIG. 33 shows a moire of the second test pattern formed at a deviated print timing, where the inspection pattern consists of oblique lines.

In accordance with one modification, the inspection pattern consists of oblique parallel lines, whereas the reference lines are vertical parallel lines as shown in FIG. 33. In this case, the inspection pattern includes the oblique parallel lines L1 created in the course of the forward motion of the main scan and the oblique parallel lines L2 created in the course of the backward motion of the main scan, which appear alternately in the main scanning direction. In this modified arrangement, the test pattern of FIG. 31 is also formed at the appropriate print timing. When the print timing of parallel lines is deviated, on the other hand, the interval between the oblique parallel lines is varied to change the moire pattern as shown in FIG. 33.

Figure 34:
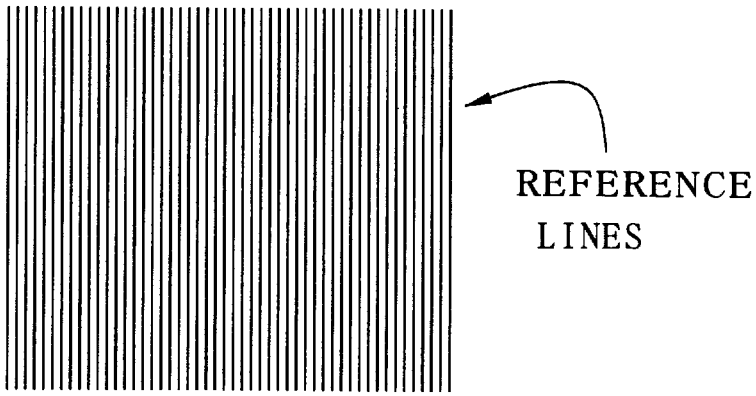
FIG. 34 shows an inspection pattern for a third test pattern formed in the third embodiment.
Figure 35:
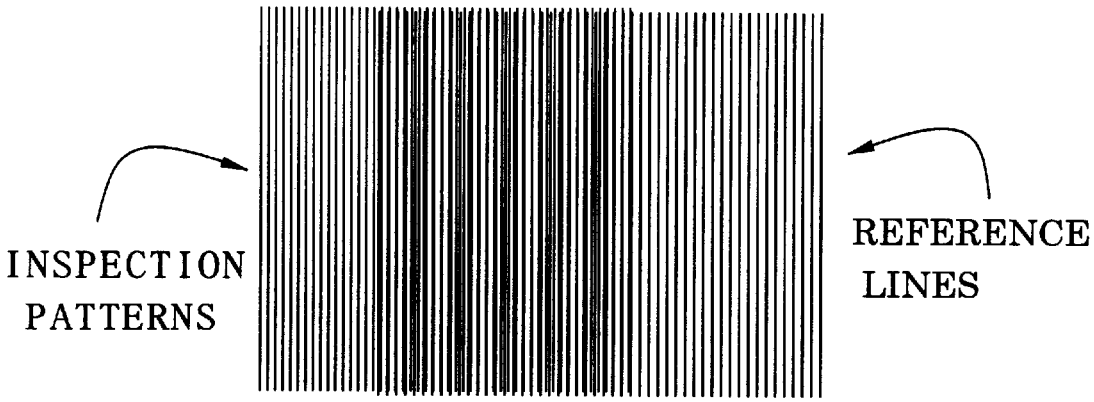
FIG. 35 shows a moire of the third test pattern formed at an appropriate print timing.
Figure 36:
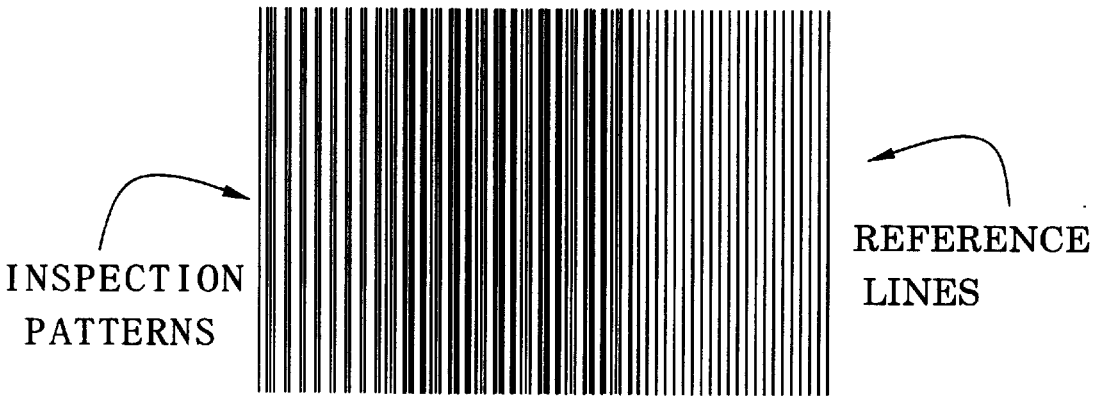
FIG. 36 shows a moire of the third test pattern formed at a deviated print timing.

In another example, both the inspection pattern and the reference lines may consist of the vertical parallel lines. FIG. 34 shows the reference lines in this example. The inspection pattern is identical with the pattern shown in FIG. 24. The reference lines shown in FIG. 34 are vertical parallel lines arranged at a greater interval than that of the inspection pattern. Superposing the inspection pattern upon the reference lines causes light-dark stripes to appear as shown in FIG. 35. In case that the print timing is deviated, the interval between the vertical lines constituting the inspection pattern is varied. Superposing the inspection pattern upon the reference lines in this case changes the light-dark stripes as shown in FIG. 36. Like this example, the test pattern may be created by the inspection pattern and the reference lines which are parallel to each other.

Figure 37:
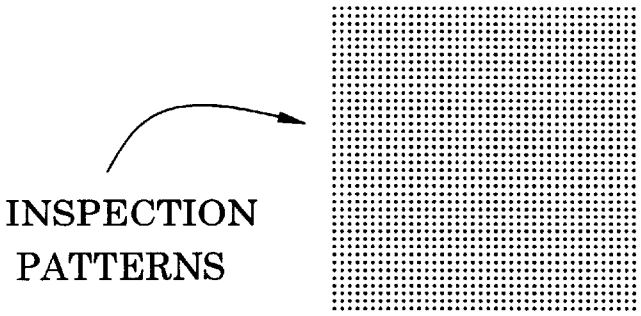
FIG. 37 shows an inspection pattern for a fourth test pattern formed in the third embodiment.
Figure 38:
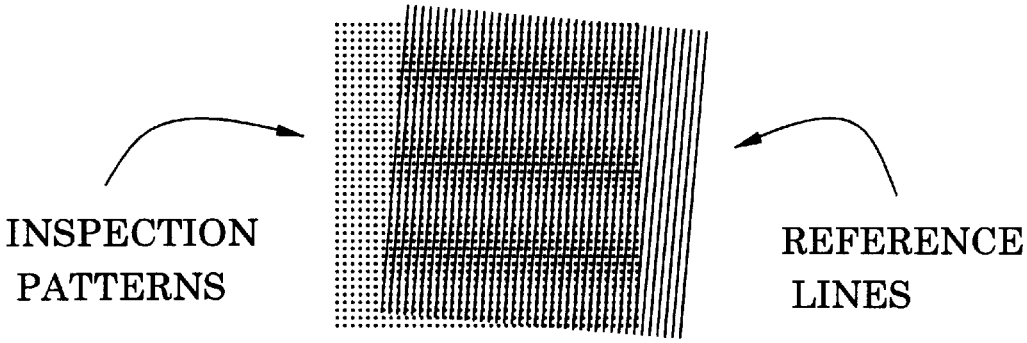
FIG. 38 shows a moire of the fourth test pattern formed at an appropriate print timing.
Figure 39:
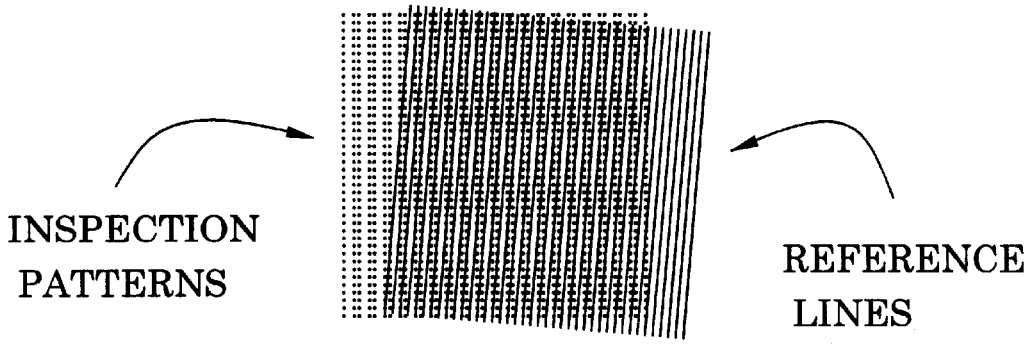
FIG. 39 shows a moire of the fourth test pattern formed at a deviated print timing.

In still another example, the normal dither matrix discussed in the first embodiment may be used as the inspection pattern. FIG. 37 shows the inspection pattern of the normal dither matrix. The reference lines used here are the oblique parallel lines shown in FIG. 25. Superposing the inspection pattern upon the reference lines causes a moire pattern as shown in FIG. 38. When the print timing is deviated, the dots constituting the inspection pattern have a variation in density in the main scanning direction, which causes a change of the moire pattern as shown in FIG. 39. A variety of other test patterns that cause a change of the moire pattern due to a deviation of the print timing may be adopted for the same purpose. For example, curves or radially arranged linear lines may be used as reference lines.

The printing media discussed in FIGS. 14 through 17 are also applicable to the printer 22 of the third embodiment. Using the printing medium on which a moire pattern is printed in advance at the ideal print timing enables the print timing to be adjusted appropriately. The ideal test patterns may be recorded by single-way printing as shown in FIGS. 18 through 21.

Figure 40:
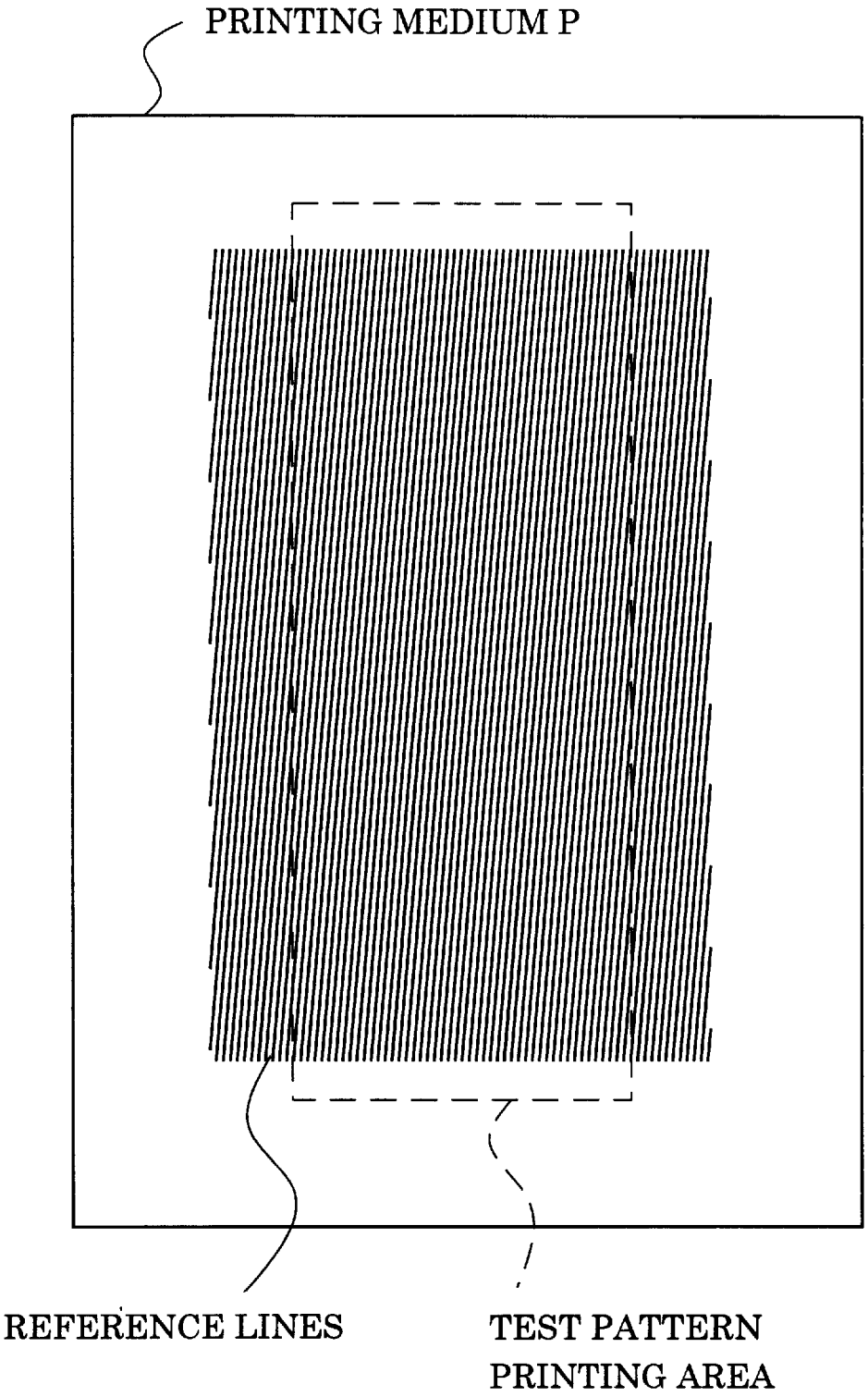
FIG. 40 shows a printing medium applicable in the third embodiment.

The test pattern of the third embodiment may be realized by a printing medium shown in FIG. 40. Reference lines are printed in advance in the central portion of the printing medium shown in FIG. 40. The printer 22 prints only the inspection pattern out of the test pattern discussed above in the area where the reference lines are printed in advance on the printing medium. Superposing the inspection pattern printed by the printer 22 upon the pre-printed reference lines causes a moire pattern and enables adjustment of the print timing.

(6) Fourth Embodiment

Figure 41:
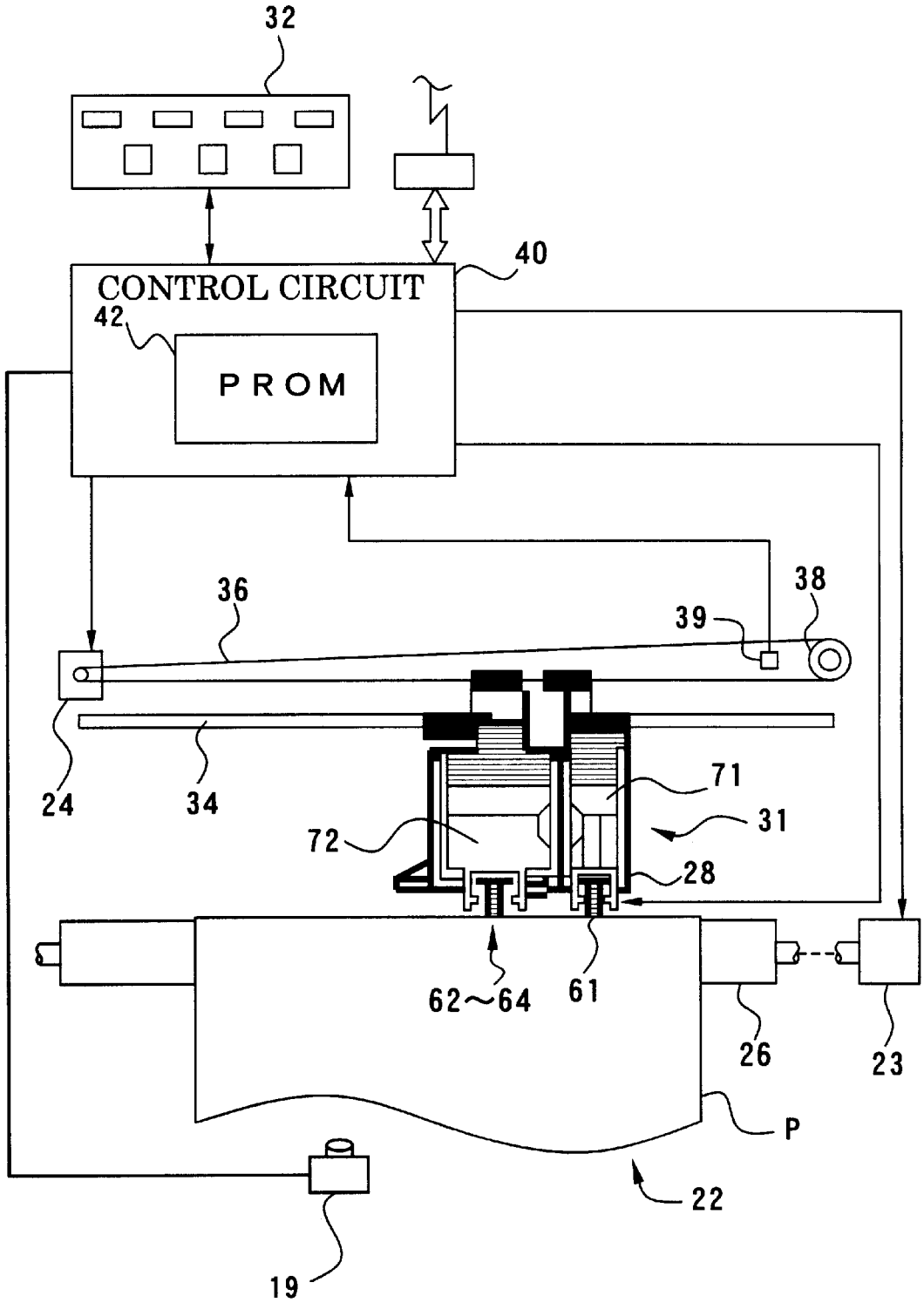
FIG. 41 schematically illustrates structure of a printer 22A as a fourth embodiment according to the present invention.

A printing apparatus given as a fourth embodiment according to the present invention reads a printed pattern with an internal camera and automatically adjusts the print timing. FIG. 41 schematically illustrates structure of a printer 22A of the fourth embodiment. The printer 22A of the fourth embodiment has a similar structure to that of the printer 22 of the first embodiment. The difference from the printer 22 of the first embodiment is that the printer 22A is provided with a CCD camera 19. The CCD camera 19 is fixed in a sheet stacker in order to input a printed image. The CCD camera 19 is connected to the control circuit 40, so that the image read with the CCD camera 19 is input into the control circuit 40. Like the structure of the first embodiment, the printer 22A is connected to the computer 90 and carries out printing in response to an instruction given from the printer driver 96.

Figure 42:
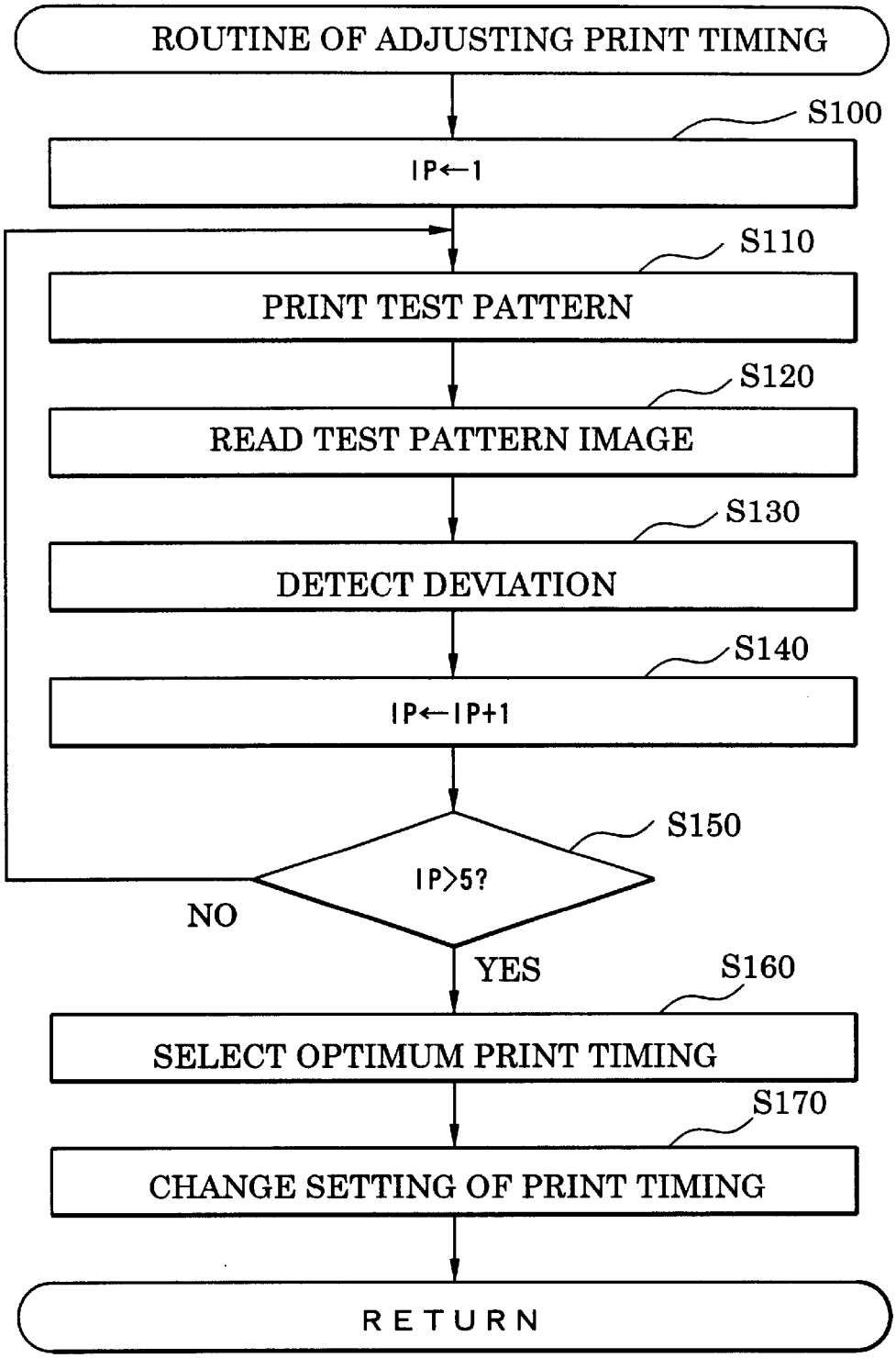
FIG. 42 is a flowchart showing a routine of adjusting the print timing executed in the fourth embodiment.

The flowchart of FIG. 42 shows a routine of automatically adjusting the print timing in the printer 22A. This routine is executed by the CPU of the computer 90 in response to an instruction given from the printer driver 96 to adjust the print timing. Alternatively the routine may be executed by the CPU included in the control circuit 40 of the printer 22A.

When the program enters the routine, the CPU initializes an index IP, which specifies the print timing, to one at step S100, and prints a test pattern at the print timing according to the value of the index IP at step S110. In this embodiment, the test pattern printed here causes a moire pattern as discussed in the third embodiment. The print timing according to the value of the index IP is set based on the value stored previously in the PROM 42 of the control circuit 40.

After printing the test pattern, the CPU reads the printed image shot with the CCD camera 19 at step S120. The CPU also analyzes the density of the input image data and measures the width of the stripes in the moire pattern. At subsequent step S130, the CPU determines the deviation of the print timing based on the width of the moire stripes. There is a substantially proportional relationship between the width of the stripes in the moire pattern and the deviation of the print timing as shown in the graph of FIG. 30. The CPU accordingly reads the deviation of the print timing corresponding to the observed width of the moire stripes from the proportional relationship previously stored in the ROM at step S130. The deviation of the print timing is mapped to the value of the index IP and stored into the RAM. The printing medium used in this embodiment is a transparent medium, which allows the printed image to be appropriately input with the CCD camera 19.

Figure 43:
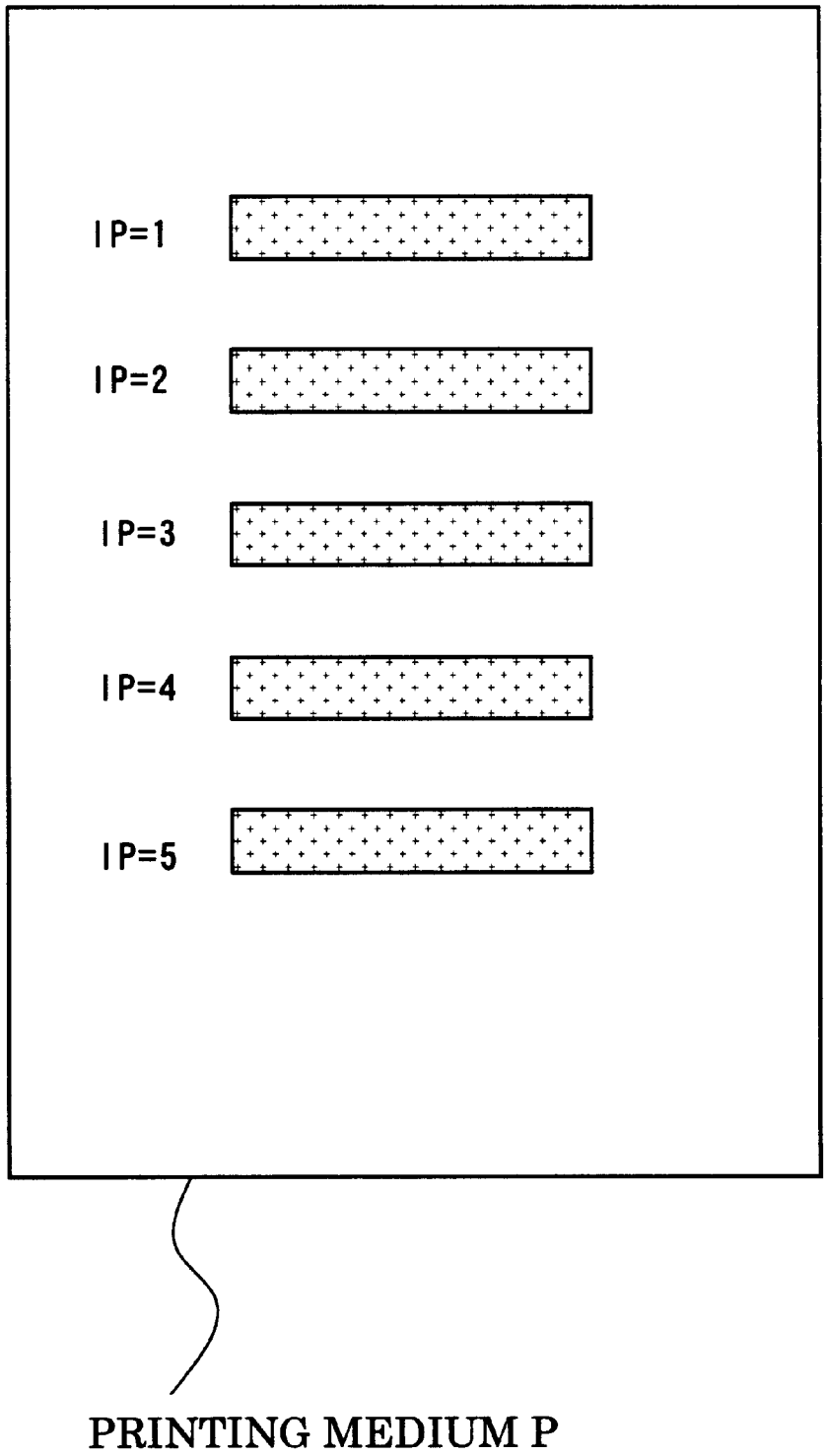
FIG. 43 shows a result of printing in the fourth embodiment.
Figure 44:
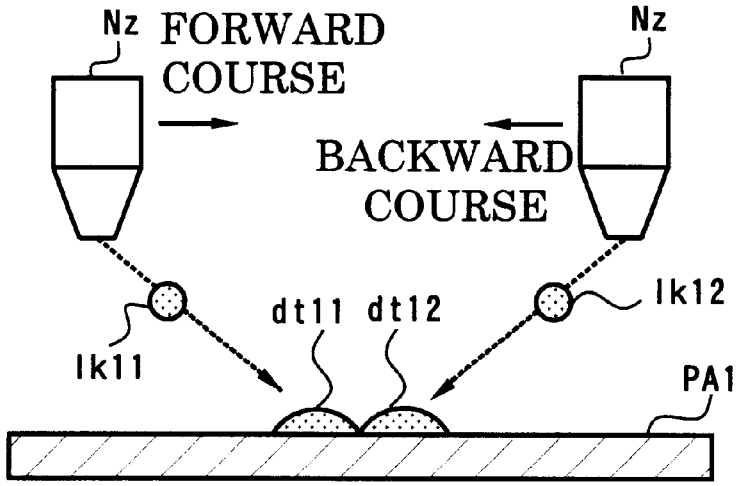
FIG. 44 shows the positions of dot formation on a sheet PA1 of a certain thickness.
Figure 45:
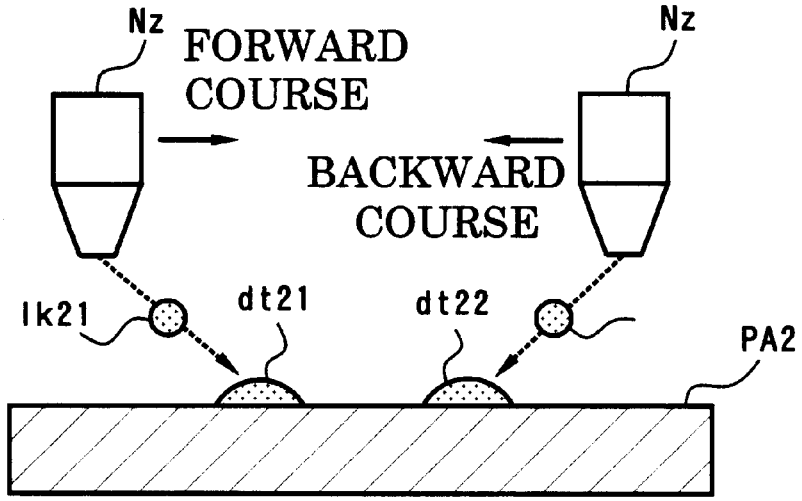
FIG. 45 shows the positions of dot formation on a sheet PA2 of a greater thickness.

The CPU then increments the index IP by one at step S140 and determines whether or not the index IP is greater than 5 at step S150. The arrangement of the embodiment selects the optimum print timing among preset five different print timings, in order to adjust the print timing. In case that the index IP is not greater than 5 at step S150, the program repeats the processing of steps S110 through S150 with the updated index IP. FIG. 43 shows a test pattern printed in this embodiment. As illustrated in FIG. 43, the test pattern is printed at five different print timings in this embodiment. The deviations of the print timing corresponding to the five indexes IP are stored into the RAM through the repeated processing of steps S110 through S150.

The CPU selects the index IP corresponding to the optimum print timing among the deviations of the print timing thus stored in the RAM at step S160. A general procedure selects the index IP corresponding to the minimum deviation. At subsequent step S170, the CPU stores the selected index IP into the PROM 42 of the printer 22A, so as to update the setting of the print timing. This completes the adjustment of the print timing.

The printer 22A of the fourth embodiment can automatically adjust the print timing. This arrangement enables adjustment of the print timing at a high accuracy since the deviation of the print timing is measured objectively prior to the adjustment. The structure enables even an unskilled user of the printer who is unfamiliar with the test patterns to adjust the print timing at a high accuracy.

The structure of the fourth embodiment prints the test pattern at five different print timings. One possible modification prints the test pattern only at one print timing. As described previously, the width of the stripes in the moire pattern correlates to the deviation of the print timing. The modified arrangement accordingly prints the test pattern at only one print timing and refers to the correlation stored in advance, in order to determine the deviation of the print timing. The procedure then adjusts the print timing by an amount corresponding to the deviation to realize the favorable print timing. The adjustment of the print timing may be carried out in this manner.

In the embodiments described above, the computer activates the printer according to the program for realizing the required functions and thereby causes the printer to print a test pattern. Another application of the present invention is thus a recording medium, on which a program for realizing the above functions is stored. The program for realizing the above functions is stored in a computer readable recording medium, such as a floppy disk or a CD-ROM. The computer reads the program from the recording medium and transfers the input program into its internal storage device or external storage device. Alternatively the program may be supplied to the computer via a communications path. The microprocessor in the computer executes the program stored in the internal storage device or the external storage device to realize the functions of the program. In accordance with another possible procedure, the computer directly reads and executes the program stored on the recording medium.

The computer used in the above embodiments is not specifically restricted but may be any computer that has a CPU, a RAM, a ROM, and an input unit and executes programs to realize the functions described above. The computer may be incorporated in the printer. Available examples of the recording medium include flexible disks, CD-ROMs, magneto-optic discs, IC cards, ROM cartridges, punched cards, prints with barcodes or other codes printed thereon, internal storage devices (memories, such as a RAM and a ROM) and external storage devices of the computer, and a variety of other computer readable media.

The present invention is not restricted to the above embodiments or their applications, but there may be many modifications, changes, and alterations without departing from the scope or spirit of the main characteristics of the present invention. For example, part of the functions realized by the software in the above embodiments may be realized by the hardware, and vice versa.

It should be clearly understood that the above embodiments are only illustrative and not restrictive in any sense. The scope and spirit of the present invention are limited only by the terms of the appended claims.

What is claimed is:

1. A method of printing a test pattern on a printing medium by driving a print head to create dots while carrying out a main scan, which moves said print head forward and backward relative to said printing medium in a main scanning direction, said method comprising the steps of:

(a) creating dots at a first timing that forms a first pattern in the course of the main scan in the forward direction, wherein said first pattern comprises a dark portion having a certain area and a light portion having an area greater than the area of said dark portion that alternately appear at a first cycle in the main scanning direction in a predetermined first section of said printing medium; and (b) creating dots at a second timing that are supposed to form a second pattern in the course of the main scan in the backward direction, wherein said second pattern comprises a dark portion having a certain area and a light portion having an area greater than the area of said dark portion that alternately appear at a second cycle in the main scanning direction in a predetermined second section of said printing medium, said predetermined second section at least partly overlapping said predetermined first section, and wherein said dark portion of said first pattern and said dark portion of said second pattern appear at a fixed interval in the main scanning direction in said overlapped area.

2. A method in accordance with claim 1, wherein said step (a) creates a plurality of dots that are apart from each other by a predetermined first interval in the main scanning direction and apart from each other by a predetermined second interval in a sub-scanning direction, and wherein said step (b) creates a plurality of dots at positions that are to satisfy at least either one of a position that is apart from each of said plurality of dots created in said step (a) by approximately half the predetermined first interval in the main scanning direction and a position that is apart from each of said plurality of dots created in said step (a) by approximately half the predetermined second interval in the sub-scanning direction.

3. A method in accordance with claim 1, wherein either one of said step (a) and said step (b) forms a third pattern superposed upon said first pattern and said second pattern, said third pattern enabling a relative deviation of a printing position of said second pattern from a printing position of said first pattern to be observed as appearance of light-dark stripes.

4. A printing medium used in a method of printing a test pattern in accordance with claim 1, wherein a test pattern to be formed in said step (a) and in said step (b) is printed in advance in a specified area at an optimum dot formation timing during the main scan in the backward direction, wherein said specified area at least partly does not overlap said predetermined first section in which said first pattern is formed in said step (a) or said predetermined second section in which said second pattern is formed in said step (b).

5. An inspection printing medium used in a method of printing a test pattern in accordance with claim 1, said inspection printing medium having a third pattern that is printed in advance in a specified area of said inspection printing medium, wherein said specified area at least partly overlaps said predetermined first section in which said first pattern is formed in said step (a) and said predetermined second section in which said second pattern is formed in said step (b), and wherein said third pattern enables a relative deviation of a printing position of said second pattern from a printing position of said first pattern to be observed as appearance of light-dark stripes.

6. A printing apparatus that drives a print head to create dots while carrying out a main scan, which moves said print head forward and backward relative to said printing medium in a main scanning direction, said printing apparatus carrying out a sub-scan that moves said printing medium relative to said print head in a sub-scanning direction, which is perpendicular to the main scanning direction, thereby printing an image on said printing medium, said printing apparatus comprising:

a forward-course pattern formation unit that drives said print head at a first timing that forms a first pattern in the course of the main scan in the forward direction, wherein said first pattern comprises a dark portion having a certain area and a light portion having an area greater than the area of said dark portion that alternately appear at a first cycle in the main scanning direction in a predetermined first section of said printing medium; and a backward-course pattern formation unit that drives said print head at a second timing that are supposed to form a second pattern in the course of the main scan in the backward direction, wherein said second pattern comprises a dark portion having a certain area and a light portion having an area greater than the area of said dark portion that alternately appear at a second cycle in the main scanning direction in a predetermined second section of said printing medium, said predetermined second section at least partly overlapping said predetermined first section, and wherein said dark portion of said first pattern and said dark portion of said second pattern appear at a fixed interval in the main scanning direction in said overlapped area.

7. A printing apparatus in accordance with claim 6, wherein said forward-course pattern formation unit drives said print head to create a plurality of dots that are apart from each other by a predetermined first interval in the main scanning direction and apart from each other by a predetermined second interval in a sub-scanning direction, and wherein said backward-course pattern formation unit drives said print head to create a plurality of dots at positions that are to satisfy at least either one of a position that is apart from each of said plurality of dots created by said forward-course pattern formation unit by approximately half the predetermined first interval in the main scanning direction and a position that is apart from each of said plurality of dots created by said forward-course pattern formation unit by approximately half the predetermined second interval in the sub-scanning direction.

8. A printing apparatus in accordance with claim 7, wherein said print head comprises a plurality of nozzles that are disposed at a predetermined nozzle interval, which is greater than a printing pitch of dots in the sub-scanning direction, one of the predetermined second interval and the predetermined nozzle interval being an integral multiple of the other.

9. A printing apparatus in accordance with claim 6, wherein said first pattern and said section pattern comprise a plurality of parallel lines arranged at an equal interval in the main scanning direction.

10. A printing apparatus in accordance with claim 6, wherein said dark portion of said first pattern and said dark portion of said second pattern alternately appear in the main scanning direction at a spatial frequency of 0.4 to 2.0 cycles/mm in said overlapped area.

11. A printing apparatus in accordance with claim 6, wherein either one of said forward-course pattern formation unit and said backward-course pattern formation unit drives said print head to form a third pattern superposed upon said first pattern and said second pattern, said third pattern enabling a relative deviation of a printing position of said second pattern from a printing position of said first pattern to be observed as appearance of light-dark stripes.

12. A printing apparatus in accordance with claim 11, wherein said third pattern comprises a plurality of parallel lines arranged at a fixed interval.

13. A printing apparatus in accordance with claim 11, wherein each pf said first pattern and said second pattern comprises a plurality of parallel lines arranged at a predetermined interval.

14. A printing apparatus in accordance with claim 11, wherein said third pattern comprises a plurality of parallel lines that obliquely intersect a plurality of parallel lines constituting said first pattern and said second pattern at a predetermined angle.

15. A printing apparatus in accordance with claim 14, wherein said predetermined angle is in a range of not less than 2 degrees and not greater than 10 degrees.

16. A printing apparatus in accordance with claim 11, said printing apparatus further comprising:

a camera with which a pattern printed on said printing medium is shot; and a detection unit that detects the relative deviation of the printing position of said second pattern from the printing position of said first pattern based on light-dark stripes appearing in said pattern shot with said camera.

17. A printing apparatus in accordance with claim 6, said printing apparatus further comprising:

a single-way pattern formation unit that drives said print head during the main scan only either in the forward direction or in the backward direction to print a pattern that is to be formed by both said forward-course pattern formation unit and said backward-course pattern formation unit in a specific area on said printing medium, said specific area being different from said predetermined first section in which said first pattern is formed by said forward-course pattern formation unit and said predetermined second section in which said second pattern is formed by said backward-course pattern formation unit.

18. In a printer that creates dots while carrying out a main scan, which moves a print head forward and backward relative to a printing medium, a method of designing a test pattern formed by the main scan both in the forward direction and in the backward direction, wherein said test pattern comprises a plurality of dots created at a predetermined interval in a predetermined area, said method comprising the steps of:

specifying a spatial frequency that gives a maximum visual sensitivity of a human's eye with respect to lightness; and determining said predetermined interval of said dots, in order to cause a spatial frequency of said test pattern to be substantially equal to said specified spatial frequency.

19. A recording medium on which a program for driving a print head and forming a test pattern, which comprises a plurality of dots, on a printing medium is stored in a computer readable manner, said program comprising:

a first program code unit that causes a computer to realize a function that drives said print head at a first timing that forms a first pattern in the course of a main scan in a forward direction, wherein said first pattern comprises a dark portion having a certain area and a light portion having an area greater than the area of said dark portion that alternately appear at a first cycle in the main scanning direction in a predetermined first section of said printing medium; and a second program code unit that causes the computer to realize a function that drives said print head at a second timing that forms a second pattern in the course of the main scan in a backward direction, wherein said second pattern comprises a dark portion having a certain area and a light portion having an area greater than the area of said dark portion that alternately appear at a second cycle in the main scanning direction in a predetermined second section of said printing medium, said predetermined second section at least partly overlapping said predetermined first section, and wherein said dark portion of said first pattern and said dark portion of said second pattern appear at a fixed interval in the main scanning direction in said overlapped area.

* * * * *